US005435719A

United States Patent [19]

McDonough et al.

[11] Patent Number: 5,435,719

[45] Date of Patent: Jul. 25, 1995

[54] SELECTIVELY ACTUATABLE LIGHTER

[75] Inventors: James M. McDonough, Guilford, Conn.; Michel Doucet, Bains/S/Oust Redon, France

[73] Assignee: BIC Corporation, Milford, Conn.

[21] Appl. No.: 965,958

[22] Filed: Oct. 23, 1992

Related U.S. Application Data

[63] Continuation-in-part of Ser. No. 723,989, Jul. 1, 1991, which is a continuation-in-part of Ser. No. 609,668, Nov. 6, 1990, abandoned, which is a continuation of Ser. No. 239,734, Sep. 2, 1988, Pat. No. 5,002,482 and a continuation-in-part of Ser. No. 912,421, Jul. 10, 1992, abandoned, which is a continuation of Ser. No. 609,668, Nov. 6, 1990, abandoned.

[51] Int. Cl.[6] ..... F23D 11/36

[52] U.S. Cl. ..... 431/153; 431/255; 431/277; 222/153.14

[58] Field of Search ..... 431/153, 344, 255, 277; 222/402.11, 153

[56] References Cited

U.S. PATENT DOCUMENTS

| | | | |
|---|---|---|---|
| 1,895,032 | 1/1933 | Fisher | 431/255 |
| 2,520,328 | 8/1950 | Nissen | 431/153 X |
| 4,784,601 | 11/1988 | Nitta | 431/153 |
| 4,784,602 | 11/1988 | Nitta | 431/153 |
| 4,786,248 | 11/1988 | Nitta | 431/153 X |
| 4,832,596 | 5/1989 | Morris, Sr. | 431/153 |
| 4,921,420 | 5/1990 | Johnston | 431/344 X |
| 5,145,358 | 9/1992 | Shike et al. | 431/153 |
| 5,165,885 | 11/1992 | Iwahori | 431/153 |
| 5,165,886 | 11/1992 | Frigiere | 431/153 |
| 5,205,729 | 4/1993 | Iwhori | 431/153 |
| 5,217,364 | 6/1993 | Frigiere | 431/344 |
| 5,224,854 | 7/1993 | Ansquer | 431/153 |
| 5,228,849 | 7/1993 | Frigiere | 222/153 X |

FOREIGN PATENT DOCUMENTS

| | | | |
|---|---|---|---|
| 4186018 | 4/1992 | Japan | 431/153 |
| 8902796 | 8/1989 | Spain | 431/153 |

*Primary Examiner*—Carl D. Price
*Attorney, Agent, or Firm*—Pennie & Edmonds

[57] ABSTRACT

A selectively actuatable lighter device is disclosed which includes a body defining reservoir for containing a combustible gaseous medium such as butane, and having a valve arranged to be selectively actuated between a normally closed position and an open position which permits the exit of the gaseous medium. Such lighter can selectively produce sparks at a location proximate to the gaseous medium exit to ignite the gaseous medium. Such lighter device embodies a resiliently releasable latch means which normally prevents actuation of a valve actuator to the open position thereby preventing actuation of the valve. The latch means includes a latch which is selectively movable to a position out of interference with the valve actuator, so that the gaseous medium may be released and ignited by the sparks. The latch means is resiliently structured and mounted such that once the valve actuator is depressed and released, the latch returns to its closed or latched position to prevent actuation of the valve to the open position. To "re-use" the lighter, the latch must again be moved to an unlatched position so that the valve actuator can be opened for subsequent ignition of the gaseous medium.

47 Claims, 13 Drawing Sheets

SELECTIVELY ACTUATABLE LIGHTER

CROSS-REFERENCE TO RELATED APPLICATIONS

This is a continuation-in-part of U.S. patent application Ser. No. 07/723,989 filed on Jul. 1, 1991, entitled "Selectively Actuatable Lighter", which is a continuation-in-part of U.S. patent application Ser. No. 07/609,668 filed on Nov. 6, 1990, entitled "Selectively Actuatable Lighter", abandoned, which is a continuation of Ser. No. 07/239,734 filed on Sep. 2, 1988, entitled "Selectively Actuatable Lighter", which issued on Mar. 26, 1991 as U.S. Pat. No. 5,002,482. This is also a continuation-in-part of U.S. patent application Ser. No. 07/912,421, filed on Jul. 10, 1992, entitled "Selectively Actuatable Lighter", now abandoned, which is a continuation of U.S. patent application Ser. No. 07/609,668, filed Nov. 6, 1990, now abandoned. Each of these four patent applications is incorporated herein by reference.

BACKGROUND OF THE INVENTION

This application is also related to U.S. Pat. No. 5,125,829, entitled "Bidirectional Selectively Actuatable Lighter" which issued on Jun. 30, 1992, and U.S. Pat. No. 5,092,764, entitled "Selectively Actuatable Lighter With Locking Value Cap" which issued on Mar. 3, 1992. This application is also related to U.S. patent application Ser. Nos. 07/965,596, 07/965,831 and 07/965,832, each entitled "Selectively Actuatable Lighter" and each filed concurrently herewith. Each of these two patents and three patent applications is incorporated herein by reference.

TECHNICAL FIELD

This invention relates generally to lighters which consume fuel such as, for example, butane which is stored in a reservoir in a liquid state, then passed through a valve means and finally ignited by a spark or other similar means. More particularly, the invention relates to a butane cigarette lighter having a feature which interferes with depression of a valve actuator and in turn hinders expulsion of fuel from a valve nozzle (i.e., fuel nozzle) and/or generation of sparks thereby rendering operation of the lighter by young children even more difficult. Advantageously, this feature of the lighter may be deactivated by moving a latch to a non-interfering position, thus facilitating flame production.

DESCRIPTION OF THE ART

Numerous lighters are known, some of them incorporating features which are designed to render operation of the lighter more difficult by certain users. Some of such features relate to mechanisms which are designed to prevent ignition of a fuel source unless the lighter is properly oriented, mechanisms which are designed to automatically turn off a fuel source supply valve, and tamper protection arrangements.

More recently, attention has been directed toward preventing ready actuation of such lighters by persons normally not able to appreciate the potential danger of the flame. Individuals normally contemplated in these efforts are young children, in the age category younger than five years.

U.S. Pat. No. 4,784,601 to Nitta relates to a gas lighter having an L-shaped slideable stopper which is positionable to prevent descent of a gas lever which controls fuel flow. The lighter is rendered operable by moving the stopper outward so that its vertical leg is displaced from the top surface of the lighter housing. The L-shaped slideable stopper must be manually moved into its locking position each time it is desired to lock the lighter.

U.S. Pat. No. 4,784,602 to Nitta relates to a gas lighter having an L-shaped slideable stopper which is positionable to prevent descent of a gas lever which controls fuel flow. The lighter is rendered operable by moving the stopper inward so that its vertical pin engages a hole in the surface of the lighter housing. The L-shaped slideable stopper must be manually moved into its locking position each time it is desired to lock the lighter.

U.S. Pat. No. 4,786,248 to Nitta relates to a piezoelectric lighter equipped with a thumb-latch slideably fitted within a lighter casing. The thumb latch is manually slideable into and out of a position which interferes with depression of a thumb-pusher. The lighter is rendered operable by manually sliding the thumb-latch to an unlocked position. After operation of the lighter a user must manually slide the thumb-latch to its locked position in order to lock the lighter.

U.S. Pat. No. 4,904,180 to Nitta relates to a piezoelectric lighter equipped with a lock means which automatically returns to a locked position after use of the lighter. The lock means includes a stopper and a leaf-spring which keeps the stopper urged toward the windshield. The lighter may only be operated after the stopper is drawn backwards, away from the windshield. The lighter cannot maintain the stopper in the drawn back position without the application of constant force by a user. That is, no means are provided to maintain the lighter in an unlocked configuration.

U.S. Pat. No. 1,895,032 to Fisher relates to a lighter in which a manual control means is movable out of engagement with a shoulder portion of the lighter so as to enable the manual control means to be depressed thereby causing the lighter to operate. The control means returns to its position in engagement with the shoulder portion after use of the lighter. The lighter cannot maintain the control means in its out of engagement position without the application of constant force by a user.

U.S. Pat. No. 4,830,603 to Cirami relates to a cigarette lighter in which a locking mechanism is provided partially under a valve-actuating push-button and extends into a compartment appended to but distinct from a fuel compartment. The locking mechanism relocks itself after each depression of the push-button. In particular, one end of a stiffly flexible spring steel wire is held firmly in place in the compartment. Another end of the spring steel wire forms a probe extending into a channel provided in the underside of the push-button. The spring steel wire, in a locked configuration, prevents depression of the push-button by engaging a low ceiling on the underside of the push-button. A portion of the spring steel wire in the form of a loop extending outward from the lighter is accessible by an operator and may be suitably moved by the operator thereby causing the probe to move within the channel in the underside of the push-button.

U.S. Pat. No. 4,832,596 to Morris, Sr. relates to a cigarette lighter having a stop member slideably mounted thereon for releasably engaging a gas valve actuating lever. In particular, a spring biased stop member is slideably mounted on a top portion of a conventional disposable cigarette lighter. The stop member is biased so as to place one of its ends under the lighter's gas valve actuating lever so as to prevent movement of the lever in a direction which may open the gas valve. The lever may be actuated once the stop member is pushed in a direction opposite to the biasing force of the spring so as to slide the end which is under the lighter's gas valve outward.

U.S. Pat. No. 4,717,335 to Loveless relates to a cigarette lighter in which rotation of a spark-producing wheel is limited. In particular, the spark-producing wheel may be rotated in one direction to deliver a spark toward a nozzle through which gaseous fuel is passed, thereby causing the fuel to ignite and operating the lighter. Rotation of the spark-producing wheel in the other direction may deliver a spark away from the nozzle. The spark-producing wheel has a pin-shaped structure attached thereto which serves to limit the rotation of the wheel to under 360° by contacting the housing structure. Thus, whether a spark indeed is produced depends upon the direction of attempted rotation and the position of the pin-shaped structure relative to the housing structure. In theory, once the lighter is operated and the fuel ignited, and the pin-shaped structure has traversed its entire path of travel, subsequent operation of the lighter is impeded since the pin-shaped structure comes into contact with the housing, preventing a spark from occurring in the vicinity of the fuel nozzle.

U.S. Pat. Nos. 4,028,043 and 4,049,370 each to Neyret relate to presale tamper protection mechanisms which partially surround a spark-producing wheel, fuel nozzle or depressible valve actuation member of a lighter. These presale tamper protection mechanisms are attached to the lighter housing by frangible webs and are removed by a purchaser after sale of the lighter to expose the spark-producing wheel, fuel nozzle and/or depressible valve actuation member. However, such a presale tamper protection mechanism is of limited value once initially removed by a purchaser.

U.S. Pat. Nos. 3,547,566 to Tamarin and 3,899,286 to Lockwood et al. relate to lighters having orientation sensing mechanisms which hinder or prevent actuation of the lighter in an inverted position. Unfortunately, such mechanisms may not provide a sufficient degree of child resistancy to young children who tamper with the lighter since they merely hinder operation in prescribed orientations.

U.S. Pat. No. 4,921,420 to Johnston relates to a disposable lighter having a release means that is physically separated from the conventional lighting means. The lighter may only be operated once the release means is released. The distance separating the release means and the conventional lighting means is intended to be sufficiently large so as to make it difficult for small children to operate the lighter.

U.S. Pat. No. 5,074,781 to Fujita relates to a cigarette lighter having a lock member which must be rotated in a specified direction towards one side of the lighter so as to allow a depressible valve actuator to be depressed and the lighter to operate.

U.S. Pat. No. 5,076,783 to Fremund relates to a lighter having a depressible valve actuator which is coupled to a vertical rod which extends to an opposite end of the lighter where it contacts a locking member. The locking member must first be displaced so as to enable depression of the valve actuator.

U.S. Pat. No. 5,090,893 to Floriot relates to a lighter having a protruding slide member which, when in a first position, prevents depression of a valve actuator. The slide member is slideably movable to a second position in which the valve actuator may be depressed. The slide member is retained in each of the first and second positions by its interaction with and configuration relative to the lighter housing. The slide member is initially moved from its second position toward its first position by forces applied directly from the valve actuator. The slide member is not capable of vertical movement.

Many mechanisms which are designed to render operation of the lighter more difficult by certain users are unnecessarily complicated, present difficulty in their manufacture and/or exhibit a high likelihood of mechanical failure during use. Another disadvantage found in some devices is that the particular construction employed limits the shape and size of the lighter housing due to the requirement that the housing be large enough to accommodate such mechanism(s). Further disadvantages relate to the relative ease with which some mechanisms may be defeated and to the reliability of the mechanisms. For example, some mechanisms may be overridden or removed with relative ease. Additionally, some devices are not equally adaptable for use by both right-handed and left-handed users, and some include inconveniently shaped or positioned levers or knobs which need to be actuated by the user in order to operate the lighter. Similarly, some devices which may indeed be equally adaptable to both right-handed and left-handed users employ a mechanism which is actuated differently and/or moved to different positions depending on whether the user is right-handed or left-handed. Furthermore, some of these devices require repositioning of the lighter in an operator's hand after actuation of the mechanism and before the lighter is operated to produce a flame. For example, some lighters include an actuatable mechanism located sufficiently far from a valve actuation means, or on another side of the lighter than the valve actuation means, so as to result in awkward operation of the lighter.

Although it is known to prevent or hinder presale actuation of a depressible valve actuation member or actuation of a lighter in a specified orientation, none of the above-described lighters provides an efficiently manufacturable, relatively small, reliable mechanism for preventing actuation of the depressible valve actuation member and equally adaptable for use by both right-handed and left-handed users and which is similarly actuated by both right-handed and left-handed users.

As will be appreciated, development of a "child-proof" lighter per se is probably not viable. At best, it can be reasonably sought to create a lighter having features which enhance its child-resistant capability, but how "child-resistant" a lighter will be will depend upon many factors and circumstances. Nevertheless, any lighter having features which enhance its child-resistant capability will have limitations with respect to young children, and no such lighter should provide parents or adults with a false sense of security so that they may become less cautious in their handling of the lighter or permit access to the lighter by young children. Further, such lighters should not be made so difficult to light as to cause adults to use alternative forms of lighting, i.e., matches, which are generally considered to be potentially more dangerous.

The present invention is directed toward a reliable flame producing lighter which is selectively actuatable in such a manner as to provide a substantial degree of difficulty for young children—younger than five years—to actuate the lighter and produce a flame, while being user friendly and capable of actuation by adults.

SUMMARY OF THE INVENTION

This invention relates to a selectively actuatable flame producing lighter having a latch means comprising a latch which is normally in a latched position and which is movable to an unlatched or non-interfering position in which the lighter may be operated. The latch is preferably relatively flush mounted with respect to the lighter housing when in its normally latched position. Additionally, the latch is preferably not under any loading or stress when in its latched position, and is retained in such position by its interaction with and configuration relative to the valve actuator. Once in its unlatched position, depression and release of the valve actuator results in movement of the latch toward its latched position.

Advantageously, the latch may be operated with the same finger or, a fingernail of the same finger, a user employs to depress a valve actuation lever, without requiring repositioning of the lighter in a user's hand. The lighter is adapted for use by right-handed as well as left-handed users with the same relative ease. The lighter is preferably similarly actuated by both right-handed and left-handed users, without detracting from the effectiveness of the lighter's child-resistant capability. That is, the latch is preferably movable along only a single path from its latched position to its unlatched position, whether operated by right-handed or left-handed users.

One particular embodiment of the invention relates to a flame producing lighter which comprises a housing defining a reservoir for containing a combustible gaseous medium such as fuel under pressure; valve means arranged for selective actuation between a normally closed position which prevents exit of the gaseous medium from the reservoir, and an open position which permits exit of gaseous medium from the reservoir through the valve means; means for selectively producing sparks at a location proximate the gaseous medium exit opening of the valve means thereby selectively causing ignition of the gaseous medium; means normally positioned for preventing actuation of the valve means to the open position, the valve actuation prevention means being capable of vertical movement in the lighter and being movable out of the normal position into a second position only by application of an external force; and means for selectively moving the valve actuation prevention means inward and in a vertical direction toward the second position whereby actuation of the valve means to the open position is permitted thereby selectively permitting exit of the combustible gaseous medium from the valve means and ignition of the gaseous medium by sparks produced by the spark producing means, wherein the valve actuation prevention means automatically returns to the normal position after actuation of the lighter. The lighter preferably includes means to retain the valve actuation prevention means in the second position, thus retaining the lighter in an unlatched configuration. Such retention means may include portions of the housing and/or portions of the valve actuation prevention means and/or portions of the valve actuator. Additionally, the valve actuation prevention means of the lighter is preferably constrained to move along only a single path from its normal, or latched, position to the second, or unlatched, position.

In this embodiment, the valve means is preferably actuated to the open position by actuator means and the means for preventing actuation of the valve means to the open position comprises interference means for preventing movement of the actuator means, the valve actuation interference means being selectively movable to a position out of interference with the valve actuator means. The valve actuation interference means is normally retained in a valve actuation interference position, the movement thereof to the position out of interference with the valve actuator means is resiliently provided. Advantageously, the resilient movement of the valve actuation interference means causes the valve actuation interference means to return to its position beneath the valve actuator once the valve actuator is released, thus preventing the valve nozzle from opening.

The valve actuation interference means may take on a variety of forms such as a latch means, a latch or an interference member and may be movable in a variety of directions. Such movement is generally first in one direction, then in another direction. Alternatively, such movement may be in three or more directions, such as any combination of cross-wise, inward, upward and downward movements. For example, the latch may be movable first inward and then upward into a notch or cavity in or near the valve actuator until the valve actuator is depressed, whereby fuel exits the valve and the latch moves back under the valve actuator to its interference position when the valve actuator is released. Similarly, the latch may be movable first inward and then downward into a notch or cavity in or near the housing. The latch is illustrating slideably and pivotally mounted to the valve actuator.

The spark producing means of the lighter preferably includes flint material and a rotatable spark-producing wheel which has a toothed surface positioned and arranged to selectively frictionally contact the flint material. Alternatively, the means for selectively producing sparks may be an electric spark-producing means, such as a piezoelectric spark-producing means.

Another embodiment of the invention relates to a flame producing lighter resistant to unauthorized use and normally maintained in a latched configuration comprising a housing; fuel supply means for supplying fuel to be ignited; ignition means for igniting the fuel; valve means for controlling the flow of the fuel; a valve actuator which normally prevents the flow of the fuel when in a first position and is depressible to a second position which permits actuation of the fuel supply means thereby permitting fuel to flow out from the fuel supply means; and a latch positioned so as to normally prevent depression of the depressible valve actuator and normally maintain the lighter in the latched configuration. Preferably, the latch includes at least a portion normally positioned between at least a portion of the valve actuator and at least a portion of the housing.

In this embodiment, inward movement of the latch enables an interfering portion of the latch to become aligned with a cavity in or near the actuator, the cavity being sufficient in size to accommodate the interfering portion so as to eventually enable the valve actuator to be depressed. Such inward movement of the latch is followed by upward movement which causes the aligned interfering portion of the latch to enter the cavity and places the lighter in an unlatched configuration in which the valve actuator is capable of being depressed, thereby permitting fuel to flow, the unlatched configuration preferably being resiliently maintained. Alternatively, inward movement of the latch may enable an interfering portion of the latch to become aligned with a cavity in or near the housing, and subsequent downward movement of the latch would place the lighter in its unlatched configuration.

Another embodiment of the lighter employs actuator means having a first interfering portion, and means for preventing movement of the actuator means, such prevention means having a finger actuatable portion and a second interfering portion, the first and second interfering portions being normally in alignment with each other thereby preventing movement of the actuator means, the finger actuatable portion being selectively movable so as to move the second interfering portion out of alignment with the first interfering portion, the second interfering portion being normally retained in a valve actuation interference position, the movement thereof to a position out of interference with the valve actuator means being resiliently provided so as to return the second interfering portion to its position in interference with the valve actuator when the valve actuator is released, thus preventing the valve nozzle from opening.

In this embodiment, the movement of the finger actuatable portion which causes the second interfering portion to move out of alignment with the first interfering portion is constrained to movement in a single path. The movement of such finger actuatable portion comprises movement first in an inward direction and then movement in an upward direction. Alternatively, the first interfering portion may be formed in the housing of the lighter, and the movement of the finger actuatable portion is first in an inward direction and then in a downward direction.

Another embodiment of the invention relates to a fuel cut-off mechanism for use in combination with a lighter which comprises means for normally preventing release of fuel from a fuel supply; means for selectively permitting release of the fuel including a depressible valve actuator which upon depression releases the fuel; and a latch which normally interferes with depression of the depressible valve actuator, at least a portion of the latch being normally positioned so as to normally interfere with depression of the valve actuator, the latch being arranged such that inward movement of the latch enables depression of the valve actuator wherein fuel is permitted to flow. The latch portion is preferably positioned between at least a portion of the valve actuator and at least a portion of a main body housing of the lighter.

Such a fuel cut-off mechanism preferably includes means for constraining the movement of the latch to a single path equally suitable for both right-handed and left-handed users, and/or means for retaining the lighter in the unlatched configuration.

Another embodiment of the invention relates to a flame developing lighter comprising a housing; fuel supply means for supplying fuel to be ignited; ignition means for igniting the fuel; valve means for selectively permitting flow of the fuel; and control means for preventing the combination of production of fuel flow and spark generation so as to prevent production of a flame and for permitting production of fuel flow and spark generation to produce a flame.

The control means of this embodiment preferably includes a valve actuator which normally prevents release of the fuel from the fuel supply means when in a first position and is depressible to a second position which permits release of the fuel; and a latch having an interfering portion which is normally in an interfering position thereby preventing depression of the depressible valve actuator. Inward movement of the latch causes the interfering portion to move toward a non-interfering position and further movement in another direction, subsequent to the inward movement, of the latch into the non-interfering position, provides the lighter in an unlatched configuration in which the valve actuator is capable of being depressed, thereby permitting fuel to flow. Such another direction may be, for example, upward, downward, or cross-wise.

The present invention also relates to an improved lighter of the type having valve means for selectively releasing fuel, means for igniting the fuel, valve actuator means for actuating the valve means so as to release fuel, the valve means including a fuel nozzle which expels fuel when the fuel nozzle is lifted upward by the valve actuator means, wherein the improvement comprises a compensator spring which maintains the fuel nozzle in its downward position when the value actuator is initially actuated. The compensator spring is preferably positioned between the valve actuator means and a portion of the fuel nozzle so as to urge the fuel nozzle downward. The compensator spring is preferably a metallic coiled spring. The fuel nozzle is preferably normally biased downwardly by the valve actuator means.

In another embodiment, such lighter includes interference means positioned so as to normally interfere with actuation of the valve actuator means, and the compensator spring means compensates for movement of the valve actuator means when the interference means is normally positioned so as to interfere with the actuation of the valve actuator means.

Operation of the lighter requires a certain amount of dexterity and the application of concentrated forces as well as the application of a plurality of forces in multiple directions and in a specified sequence. Additionally, operation of the lighter requires a certain level of cognitive ability.

Furthermore, the lighter of the present invention is a passive latching lighter. Advantageously, the lighter automatically returns to its latched configuration once the depressed valve actuator is released. Thus, the lighter is maintained in an at-rest or default configuration which is latched thereby preventing the flow of fuel and the production of a flame.

Advantageously, the lighter is adapted for use by right-handed as well as left-handed users with the same relative ease, and is similarly actuated by both right-handed and left-handed users. Furthermore, the user may operate the latch mechanism with the same finger as used to depress the valve actuator without requiring the user to reposition the lighter in the user's hand.

BRIEF DESCRIPTION OF THE DRAWINGS

These and other objects, features, and advantages of the present invention will become more readily apparent from the following detailed description of the invention in which like elements are labeled similarly, FIGS. 18-32 depict the lighter of the present invention with an alternative embodiment of the valve actuator and latch means, and in which:

FIG. 1 is a partial perspective view of a preferred embodiment of a selectively actuatable lighter of the present invention in a latched configuration;

FIG. 2 is a partial cross-sectional view of the lighter of FIG. 1 depicting the latch in a latched configuration;

FIG. 3 is an exploded view of the valve actuator and latch depicted in FIGS. 1 and 2;

FIG. 4 is a bottom view of the valve actuator depicted in FIG. 3;

FIG. 5 is a bottom view of the latch depicted in FIG. 3;

FIG. 6 is a cross-sectional view of the valve actuator and latch depicted in FIG. 3 when in their latched configuration thereby preventing depression and actuation of the valve actuator;

FIG. 7 is a cross-sectional view of the valve actuator and latch depicted in FIG. 3 when in their unlatched configuration thereby permitting depression and actuation of the valve actuator;

FIG. 8 is a cross-sectional view of the valve actuator and latch depicted in FIG. 3 when in a configuration which is timewise intermediate of the unlatched and latched configurations;

FIG. 11 is a perspective view of the lighter of FIG. 1 in an unlatched configuration in which the latch is at its unlatched position thereby permitting depression of the valve actuator so as to permit a valve to open and gas to be released through a fuel nozzle;

FIG. 12 is a perspective view of the lighter of FIG. 11 with the valve actuator in a depressed position and the valve open and depicting a flame;

FIG. 13 is a partial cross-sectional view of the lighter of FIG. 1 in its latched configuration thereby preventing depression and actuation of the valve actuator;

FIG. 14 is a partial cross-sectional view of the lighter of FIG. 13 in its unlatched configuration and the valve actuator not depressed and the lighter ready for actuation;

FIG. 15 is a partial cross-sectional view of the lighter of FIG. 14 in its partially unlatched configuration and the valve actuator fully depressed so as to permit the flow of fuel;

FIG. 16 is a partial cross-sectional view of the lighter of FIG. 15 in greater detail;

FIG. 17 is a partial cross-sectional view of the lighter of FIG. 15 after the value actuator has been fully depressed and released;

FIG. 18 is a perspective view of another preferred embodiment of a selectively actuatable lighter of the present invention in a latched configuration;

FIG. 19 is a partial cross-sectional view of the lighter of FIG. 18 depicting the latch in a latched configuration;

FIG. 20 is an exploded view of the valve actuator and latch depicted in FIGS. 18 and 19;

FIG. 21 is a bottom view of the valve actuator depicted in FIG. 20;

FIG. 22 is a bottom view of the latch depicted in FIG. 20;

FIG. 23 is a cross-sectional view of the valve actuator and latch depicted in FIG. 20 when in their latched configuration thereby preventing depression and actuation of the valve actuator;

FIG. 24 is a cross-sectional view of the valve actuator and latch depicted in FIG. 20 when in their unlatched configuration thereby permitting depression and actuation of the valve actuator;

FIG. 25 is a cross-sectional view of the valve actuator and latch depicted in FIG. 20 when in a configuration which is timewise intermediate of the unlatched and latched configurations;

FIG. 26 is a perspective view of the lighter of FIG. 18 in an unlatched configuration in which the latch is at its unlatched position thereby permitting depression of the valve actuator so as to permit a valve to open and gas to be released through a fuel nozzle;

FIG. 27 is a perspective view of the lighter of FIG. 26 with the valve actuator in a depressed position and the valve open and depicting a flame;

FIG. 28 is a partial cross-sectional view of the lighter of FIG. 18 in its latched configuration thereby preventing depression and actuation of the valve actuator;

FIG. 29 is a partial cross-sectional view of the lighter of FIG. 28 in its unlatched configuration and the valve actuator not depressed and the lighter ready for actuation;

FIG. 30 is a partial cross-sectional view of the lighter of FIG. 29 in its partially unlatched configuration and the valve actuator fully depressed so as to permit the flow of fuel;

FIG. 31 is a partial cross-sectional view of the lighter of FIG. 30 in greater detail; and FIG. 32 is a partial cross-sectional view of the lighter of FIG. 30 after the value actuator has been fully depressed and released.

DETAILED DESCRIPTION OF THE PREFERRED EMBODIMENT

Figure 1:
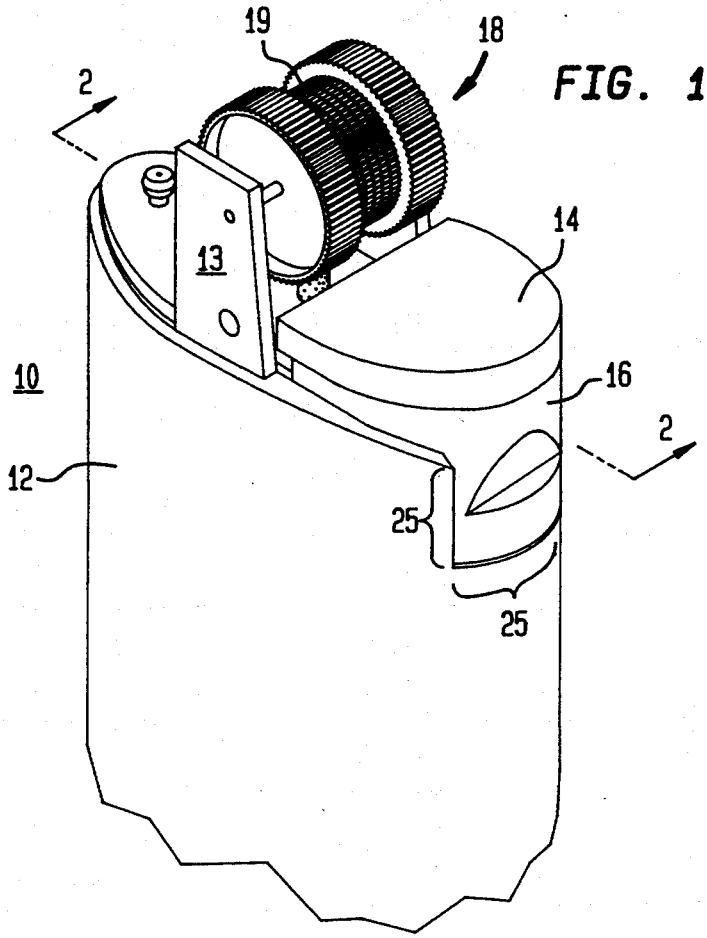
FIGS. 1–8 and 11–17 depict the lighter of the present invention with one embodiment of the valve actuator and latch means.

Referring initially to FIG. 1, there is depicted, in a default or at-rest configuration, the lighter 10 of the present invention comprising a main body portion 12, a depressible valve actuator 14, latch 16, and a spark-producing wheel assembly 18 which includes a toothed surface 19. Advantageously, the default configuration is also a latched configuration in which valve actuator 14 cannot be depressed due to the interference presented by latch 16. Depression of valve actuator 14 permits fuel to flow through a fuel nozzle and to be ignited by sparks produced by toothed surface 19 of spark-producing wheel assembly 18 frictionally engaging a flint. Advantageously, unless latch 16 is positioned away from its depicted at-rest or default position and into a non-interfering position, any attempted depression of valve actuator 14 will not result in the flow of fuel and the lighter will be inoperable. The position of latch 16 as shown in FIGS. 1 and 2 may best be characterized as a "default position" under normal conditions.

As will be appreciated, a variety of configurations, shapes and relative positioning exists for the valve actuator and the latch means in which the latch is movable, with respect to the valve actuator, between an interfering or latched position and a non-interfering or unlatched position. The invention will be described in terms of a preferred embodiment in which an illustrative latch normally interferes with depression of the valve actuator when in a latched position, and is movable to an unlatched position in which the valve actuator may be depressed. Preferably, the latch is moved from its latched position to its unlatched position along a single path, which is equally suitable for right-handed as well as left-handed users. Such movement is illustratively in an inward direction followed by a downward direction. Alternatively, such movement may be in an inward direction followed by an upward direction. As will be appreciated, for ease of understanding, such inward motion of the latch is deemed to include any inward motion or component thereof of any portion of the latch. Similarly, such upward motion of the latch is deemed to include any upward motion or component thereof of any portion of the latch, and such downward motion of the latch is deemed to include any downward motion or component thereof of any portion of the latch. Additionally, while a first movement may be described as being followed by a separate movement in a different direction, it will be appreciated that such movements or portions thereof can occur simultaneously or overlap each other as in the case of a diagonal movement having an inward as well as an upward or downward component. The latch is preferably maintained in its unlatched position after being moved there by a user, and preferably automatically returns to its latched position once a user depresses and releases the valve actuator.

A user typically holds the main body portion of a conventional lighter in his hand, rotates with his thumb the spark-producing wheel in a direction generally toward the depressible surface of the valve actuator to produce a spark, and depresses the valve actuator to allow fuel to pass through the fuel, or valve, nozzle. The spark produced by the wheel ignites the fuel. This is a relatively conventional structure for most lighters, including disposable lighters.

Figure 2:
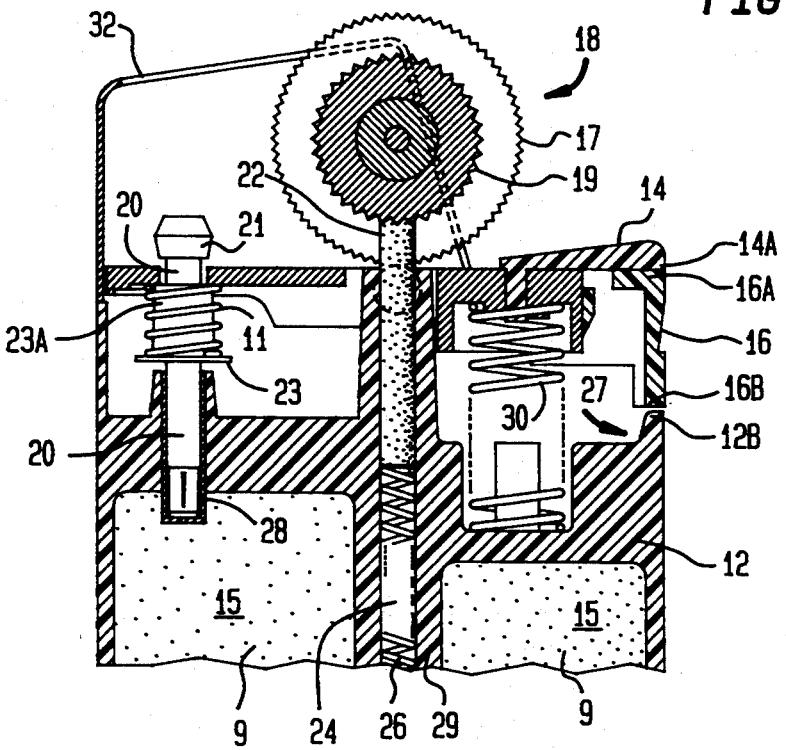

Referring now to FIG. 2, there is depicted a cross-section of the lighter of FIG. 1 in a latched configuration. More particularly, valve actuator 14 is mounted between side wall portions 13 (see FIG. 1) which illustratively comprise extensions of the side walls of body portion 12. Illustratively, valve actuator 14 is pivotally mounted to sidewall portions 13. Valve actuator 14 is attached to hollow fuel nozzle 20 slideably supported within a valve housing 28. Hollow fuel nozzle 20 is held within an opening such as a bore in valve actuator 14 by flange 21, compensator spring means 11 and flange extension 23A. Flange 21 and flange extension 23A each has a sufficient size and is configured so as to prevent slippage of nozzle 20 through the bore in valve actuator 14. Additionally, spring means 11 is maintained as shown in FIG. 2 by flange 23 which is attached to fuel nozzle 20 as is flange 21. A compressed spring means 30 resides beneath valve actuator 14 and causes fuel nozzle 20 to be urged downward into valve housing 28 and body portion 12. In particular, compressed spring 30 causes valve actuator 14 to apply force to spring means 11 which supplies force to flange 23, thereby urging nozzle 20 downward into valve housing 28 and body portion 12 and preventing the flow of fuel through nozzle 20. Additionally, downward movement of valve actuator 14 in the vicinity of nozzle 20 is limited by contact between the underside of valve actuator 14 and flange extension 23A. In such an embodiment, valve actuator 14 is employed to lift nozzle 20 by the application of force to flange 21 in order to expel fuel. A valve assembly (not fully shown) is located near the recessed end of nozzle 20 and permits fuel to flow through nozzle 20 only when valve actuator 14 is depressed and nozzle 20 lifted.

As will be appreciated, actuation of valve actuator 14 generally results in upward movement of the valve actuator in the vicinity of nozzle 20. However, in the embodiment depicted in FIG. 2, nozzle 20 remains downward during the initial upward movement of valve actuator 14 in the vicinity of nozzle 20 due to the action of compensator spring 11. More specifically, nozzle 20 only moves upward once the valve actuator in the vicinity of nozzle 20 moves upward a sufficient amount such that a top surface of valve actuator 14 in the vicinity of nozzle 20 contacts flange 21. Advantageously, depression of the valve actuator while the lighter is in a latched configuration, while possibly causing the valve actuator in the vicinity of nozzle 20 to move upward due to, for example, a gap between valve actuator interfering portion 16B and housing interfering portion 12B, will not result in any upward movement of the fuel nozzle. Accordingly, fuel will not be released in the event the valve actuator is depressed while the lighter is in a latched configuration. As will be appreciated, such use of a compensator spring is desirable in lighters which incorporate a gap allowing some depression of a latched valve actuator which would otherwise release fuel due to such depression.

Lighter 10 further comprises a sparking flint 22 mounted within a bore 24 defined by flint and spring housing 29 in main body 12. Flint 22 is urged toward toothed surface 19 of wheel assembly 18 by spring 26. Spark-producing wheel assembly 18, which includes toothed surface 19 which is preferably suitably hardened and against which flint 22 is urged, is mounted for rotation between side wall extension portions 13 in a conventional manner. Toothed surface 19 includes suitable indentations which define teeth such that when spark-producing wheel assembly 18 is rotated toothed surface 19 cuts against flint 22 causing the generation of ignition sparks. Additionally, spark-producing wheel assembly 18 includes suitable indentations 17 which facilitate rotation of spark-producing wheel assembly 18 by an operator's finger.

Main body 12 defines an internal chamber 15 which is filled with a fuel 9 such as butane fuel capable of vaporizing in a conventional manner to produce a gaseous medium which passes through fuel nozzle 20 under the control of a valve. Main body 12 is constructed from any suitable structural material or materials, and is preferably constructed from a plastic material. A shield 32, preferably constructed from metal, is provided and functions as a wind guard around the flame thereby assisting in the ignition of the fuel.

As will be appreciated, main body 12 generally encompasses any part, portion, structure or substructure of the lighter except for the valve actuator and spring, spark-producing wheel assembly, flint and spring, valve assembly, and latch means. Accordingly, what will be described as housing interfering portion 12B is deemed to include any such part, portion, etc.

As depicted in FIG. 1 and 2, a notched opening 25 is provided in body portion 12 to accommodate valve actuator 14 and latch 16 and, in particular, vertical movement of valve actuator 14 and inward as well as vertical movement of latch 16. As will be appreciated, FIGS. 1 and 2 depict the lighter in a latched configuration, i.e., a default configuration. In this latched configuration, latch 16 is positioned between valve actuator 14 and housing 12 and prevents depression of valve actuator 14, thereby preventing actuation of the valve means and thus the release of fuel.

Referring again to FIG. 2, latch 16 is depicted in its latched configuration in which an interfering portion 16A of latch 16 is positioned and configured so as to interfere with and prevent depression of valve actuator 14. More specifically, an interfering portion 14A of valve actuator 14 contacts interfering portion 16A of latch 16 upon attempted depression of valve actuator 14, thus preventing the release of fuel from fuel nozzle 20. In its latched configuration, latch 16 is prevented from any downward travel by the contact between interfering portion 16B of latch 16 and interfering portion 12B of main body 12. Alternatively, any such downward travel of valve actuator 14 may be prevented by another portion of latch 16 contacting another portion of body 12 or another portion of latch 16 contacting another portion of valve actuator 14. As will be discussed in detail in conjunction with FIGS. 3–8, latch 16 is movable inward and downward whereupon latch interfering portion 16B is no longer aligned with housing interfering portion 12B and latch interfering portion 16A is separated from valve actuator interfering portion 14A thus enabling depression of valve actuator 14. Specifically, latch interfering portion 16B is moved inward and downward at least partially into a notch or cavity 27 suitably shaped for receiving a portion of latch 16 including a tip portion which in turn includes interfering portion 16B. Preferably, cavity 27 is shaped so as to accommodate the tip portion of latch 16, including interfering portion 16B. A user desiring to actuate the lighter must first force the tip portion of latch 16, and thus interfering portion 16B, out of interference with interfering portion 12B of body 12. This is accomplished by a user moving latch 16 inward such that interfering portion 16B is moved at least partially into cavity 27. Specifically, a user applies a component of force to a finger actuatable portion of latch 16 so as to force its tip portion inward and downward into cavity 27. As will be discussed in conjunction with FIGS. 3–8, once a user moves latch 16 sufficiently inward and downward into its unlatched position, the latch will remain in its unlatched position until a user depresses and releases the valve actuator.

Figure 3:
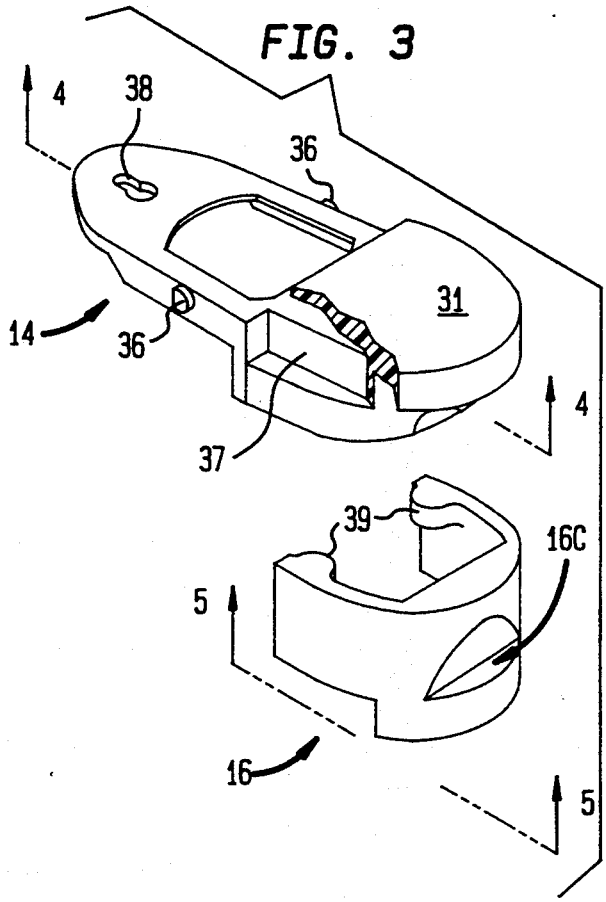

Referring now to FIG. 3, there is depicted valve actuator 14 and latch 16 in greater detail. Valve actuator 14 comprises a finger depressible surface 31, extensions 36, a nozzle opening such as a bore 38, and retaining means 37. Such retaining means illustratively comprises two channels, one located on each of two sides of the valve actuator. Extensions 36 are provided to matingly engage with bores in side wall portions 13 of body portion 12 to provide pivotal movement of the valve actuator about extensions 36. Bore 38 is adapted for receiving and grasping a portion of fuel nozzle 20 between flanges 21 and 23.

Valve actuator 14 is constructed from material having sufficient dimensional stability and rigidity to continuously over the life of the lighter assure proper relative positioning between interfering portion 14A of valve actuator 14 and interfering portion 16A of latch 16, and/or between interfering portion 16B of latch 16 and interfering portion 12B of housing 12. Actuator 14 is preferably constructed from zinc or glass-filled polyetherimide. Other illustrative materials from which valve actuator 14 may be constructed are aluminum and other glass filled polymers such as polyethersulfone or the like, as well as combinations of these materials.

Latch 16 includes retaining means 39. Illustratively, such retaining means 39 comprises two protrusions, one located on respective inner surfaces of each of two sides of the latch. Such retaining means 39 is shaped, configured, positioned and adapted to enable latch 16 to slide within channels 37 (as best depicted in FIGS. 6–8, 13, 15 and 17) as well as to enable latch 16 to pivot about pivot points within channels 37 (as best depicted in FIG. 14).

More specifically, latch 16 is slideably attached to valve actuator 14 by way of channels 37 formed in actuator 14 and protrusions 39 formed in latch 16. Such slideable attachment enables latch 16 to move inward and outward relative to valve actuator 14. Additionally, the size, shape, position and configuration of protrusions 39 prevent vertical movement of protrusions 39 relative to valve actuator 14 while permitting limited pivotal movement of the latch relative to the valve actuator. As will be appreciated, such pivotal movement is about two pivot points located at the point of contact between protrusions 39 and channels 37 at any particular time.

As will be appreciated, retaining means 37 and retaining means 39 may take on a variety of shapes, positions and configurations. Their specific structure is not critical to the present invention. Additionally, each of retaining means 37 and 39 can comprise any reasonable number (including one) of separate structures.

Latch 16 is preferably constructed from relatively rigid and somewhat flexible material which is sufficiently resilient to permit temporary widening of the distance between the two protrusions 39 of latch 16 as such protrusions slide within channels 37 during movement of latch 16 between its latched position and its unlatched position. Latch 16 is preferably constructed from any sufficiently resilient plastic or metal, although a wide variety of other suitable materials having a sufficient degree of rigidity and elastic memory may be employed.

In the latched or closed configuration (FIGS. 1 and 2), an upper surface of interfering portion 16A of latch 16 abuts a lower surface of interfering portion 14A of valve actuator 14, and a lower surface of interfering portion 16B of latch 16 abuts an upper surface of interfering portion 12B of body 12, thereby preventing depression of valve actuator 14. Alternatively, a small gap (FIGS. 1 and 2) may be provided between latch 16 and valve actuator 14, or between latch 16 and housing 12. For example, a gap may be provided between the lower surface of interfering portion 16B of latch 16 and the upper surface of interfering portion 12B of latch 12.

Figure 4:
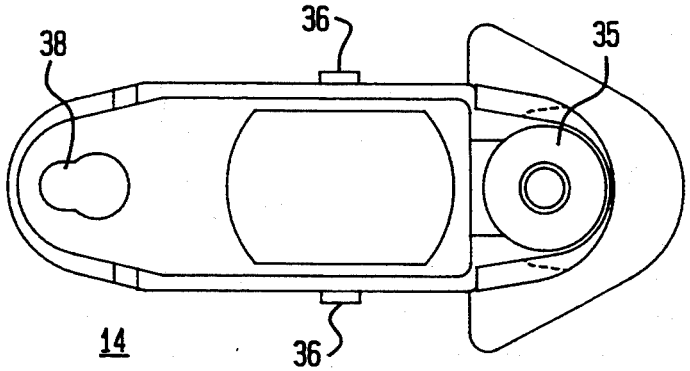

Referring now to FIG. 4, there is depicted a view of the underside of valve actuator 14 of FIG. 3. A portion 35 of valve actuator 14 is adapted to receive spring 30 as depicted in FIG. 2 and may take on a variety of forms such as a protruding member or, alternatively, an indentation or bore partially into valve actuator 14. The fuel nozzle is illustratively maintained in bore 38 by fuel nozzle flanges 21 and 23 and spring means 11 (FIG. 2) which have a diameter greater than that of a corresponding portion of bore 38.

Figure 5:
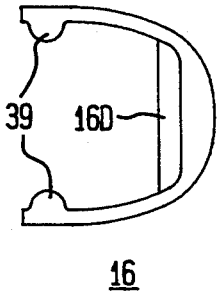

FIG. 5 depicts the underside of latch 16 of FIG. 3. The size, shape, and configuration of latch 16 facilitates retention of the lighter in an unlatched configuration as well as stabilization of latch 16 within the lighter. Finger actuatable portion 16C of latch 16 is employed by a user to move the latch and, in particular, is preferably employed by a user's fingertip to move latch interfering portion 16B inward and downward out of interference with housing interfering portion 12B. Additionally, and as will be described in conjunction with FIG. 15, latch 16 includes an engagement portion 16D which engages an indent 14C within valve actuator 14 when the valve actuator is fully depressed, thereby enabling the valve actuator to pull the latch out of its depressed position and move upward along with the valve actuator toward its latched position once the valve actuator is released.

Figure 6:
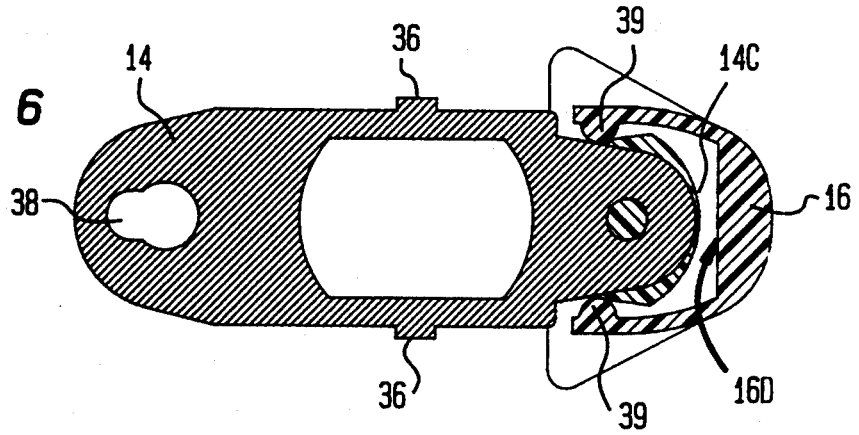
Figure 7:
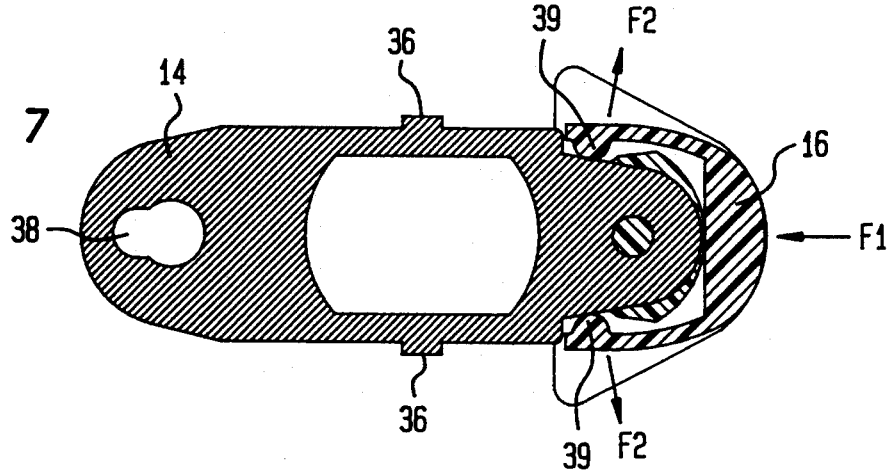
Figure 8:
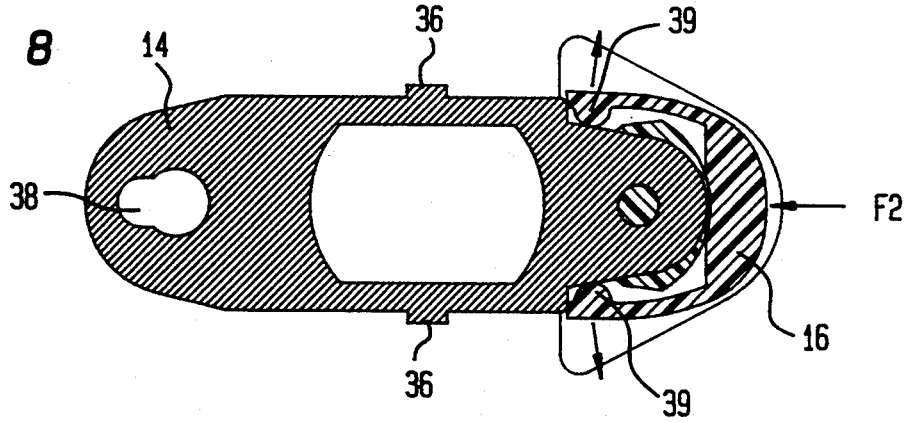

FIGS. 6, 7 and 8 are each cross-sectional views of the valve actuator and latch of FIG. 3 when in their latched (FIG. 6), unlatched (FIG. 7) and intermediate (FIG. 8) configurations. More specifically, FIG. 6 depicts latch 16 in its latched position in which latch retaining means 39 is maintained in valve actuator channels 37 in their at rest or latched positions. Additionally, latch engagement portion 16D is separated from indent 14C by a small gap. As will be appreciated, latch 16 is preferably under no loading as it is depicted in FIG. 6.

FIG. 7 depicts latch 16 in its unlatched position in which latch 16 is moved inward (F1) and downward. As will be appreciated, valve actuator 14 exerts force on latch retaining means 39 when in the latched position as indicated by arrows F2. Additionally, latch engagement portion 16D contacts valve actuator 14 at a portion of the actuator adjacent to indent 14C. Alternatively, a sufficiently small gap, smaller than that depicted in FIG. 6, may be provided between latch engagement portion 16D and actuator 14 at a portion of the actuator adjacent to indent 14C. Advantageously, the lighter maintains the unlatched configuration once it is placed in such an unlatched configuration.

Advantageously, latch 16 may only be moved from its latched position (FIG. 6) to its unlatched position (FIG. 7) by external force, i.e., a force applied by a user to latch 16. Such force must be sufficient to cause the distance between the two protrusions of latch retaining means 39 of latch 16 to widen. Additionally, such force must be sufficient to move latch 16 downward and, more specifically, to cause latch 16 to pivot downward about the points of contact between latch retaining means 39 and valve actuator 14 thereby moving latch interfering portion 16B out of interference with housing interfering portion 12B and moving valve actuator interfering portion 14A away from latch interfering portion 16A. Accordingly, absent the application of such force, the lighter of the present invention is normally maintained in its latched configuration.

As will be appreciated, the unlatched configuration depicted in FIG. 7 cannot be self-maintained. Specifically, the force (F2) exerted by the valve actuator on the latch results in a biasing force which tends to bias latch 16 outward of the lighter, that is, in a direction opposite that indicated by F1. In other words, latch 16 is squeezed away from valve actuator 14 whenever latch 16 is positioned in its latched position. Accordingly, absent any further means to maintain the valve actuator and latch as depicted in FIG. 7, such biasing force would tend to bias the latch out of its unlatched position. However, and as described in conjunction with FIG. 14, a portion of housing 12 facilitates the retention of latch 16 in its unlatched position.

Additionally, due to the relative materials from which valve actuator 14 and latch 16 are constructed, and due to their relative shapes and configurations, only latch 16 is deformed during the transition between its latched and unlatched positions and when in its unlatched position. In the preferred embodiment illustrated in FIGS. 6–8, such deformation comprises a temporary widening of the distance between the two protrusions of latch retaining means.

Referring now to FIG. 8, valve actuator 14 and latch 16 are depicted in a configuration which is timewise intermediate the unlatched configuration of FIG. 7 and the latched configuration of FIG. 6. As depicted in FIG. 8, latch 16 is under loading and is temporarily deformed. Additionally, and as more clearly depicted in FIGS. 15 and 16, latch engagement portion 16D is placed at least partially within valve actuator indent 14C. The configuration depicted in FIG. 8 occurs for a brief period of time as valve actuator 14 is depressed and moved downward thereby forcing latch 16 further inward relative to actuator 14. As described in conjunction with FIG. 7, the configuration depicted in FIG. 8 cannot be self-maintained as the latch is biased outward in a direction opposite that indicated by arrow F2 of FIG. 8.

As will be appreciated, the materials and configurations of valve actuator 14 and latch 16 as well as their shapes cause valve actuator 14 to force latch 16 away from actuator 14 for all positions of the latch, except for its latched position, thereby biasing the latch toward its latched position once it becomes disengaged from the actuator.

Figure 9:
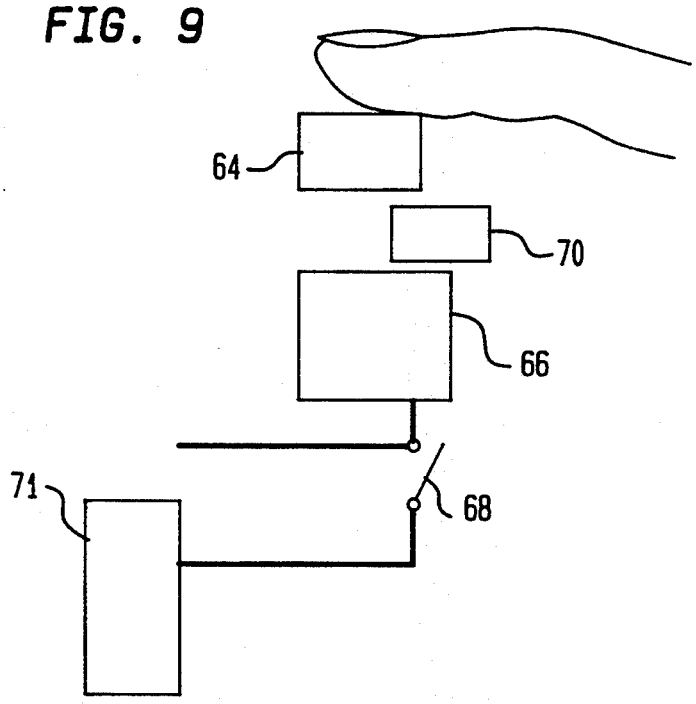
FIG. 9 is a schematic diagram depicting a piezoelectric lighter apparatus in which the present invention may be employed and having an optional switch depicted in the open position and a latch means depicted in the latched position to prevent the production of sparks and the flow of fuel.

FIG. 9 schematically depicts a piezoelectric type lighter in which the present invention may be employed. The piezoelectric lighter comprises hammer and fuel release means 64, spark providing means 66, optional electrical cut-off switch 68, latch means 70 and valve means 71. The piezoelectric lighter operates in a conventional manner except for depression of hammer means 64 which is prevented by inclusion of latch means 70 operative in accordance with the present invention. Illustratively, such latch means comprises a latch which prevents the production of sparks. In particular, latch means 70 may prevent the production of sparks by electrically and/or mechanically isolating an energy source from the spark producing means. Alternatively, the latch means may be arranged to selectively prevent only the flow of fuel or it may be arranged to selectively prevent both the production of sparks and the flow of fuel. As depicted in FIG. 9, the lighter is in a latched configuration since latch means 70 is positioned so as to prevent actuation of hammer means 64. Additionally, optional switch 68 is depicted in an open, or off, position.

Figure 10:
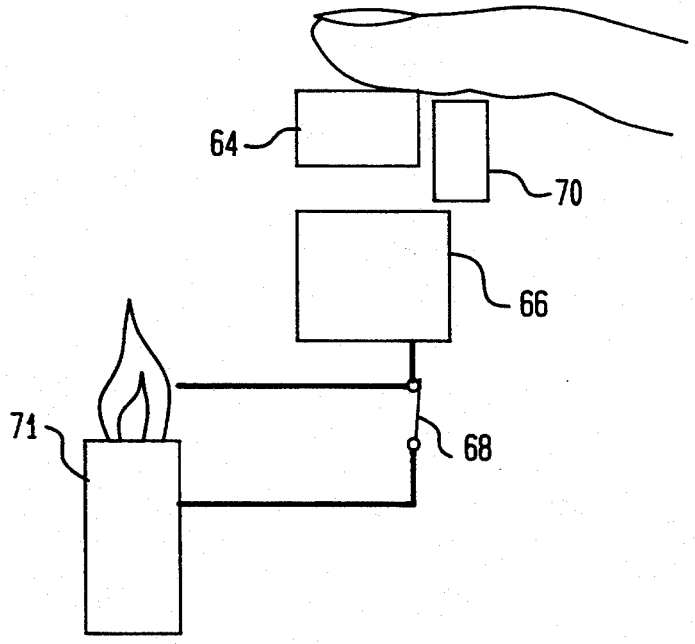
FIG. 10 is a schematic diagram depicting the piezoelectric lighter of FIG. 9 with the switch depicted in the closed position and the latch means depicted in the unlatched position and depicting a flame.

FIG. 10 schematically depicts the piezoelectric type lighter of FIG. 9 in an unlatched configuration. In particular, latch means 70 is positioned so as to enable actuation of hammer means 64. Additionally, switch 68 is depicted in a closed, or on, position. As will be appreciated, incorporation of optional switch 68 requires that it be closed and that latch means 70 be unlatched in order for fuel to be ignited.

Advantageously, the present invention automatically returns the latch to its latched position after the lighter has been activated and, in particular, after the valve actuator has been depressed and released. Additionally, the present invention maintains the lighter in an unlatched configuration once a user places the lighter in such a configuration. Such features will now be further described in conjunction with FIGS. 1, 11 and 12.

Figure 11:
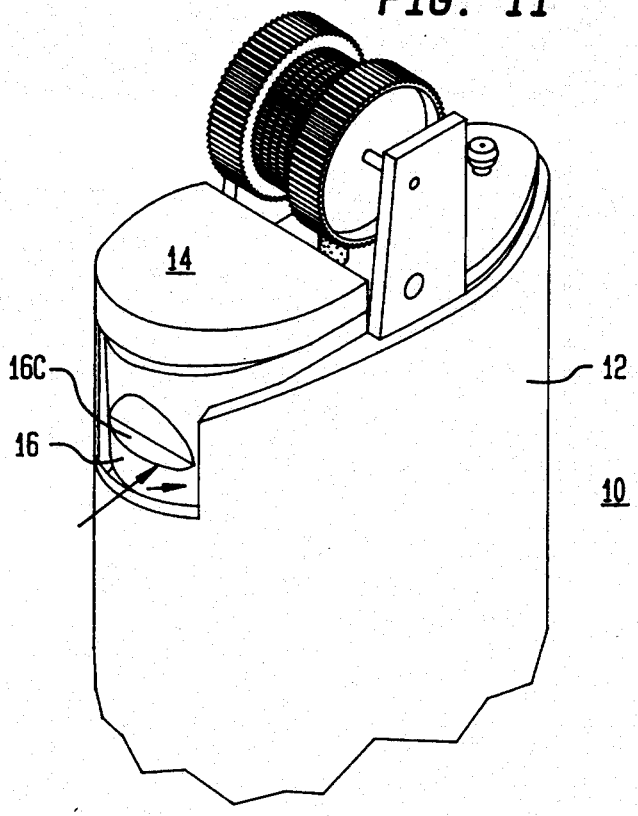
Figure 12:
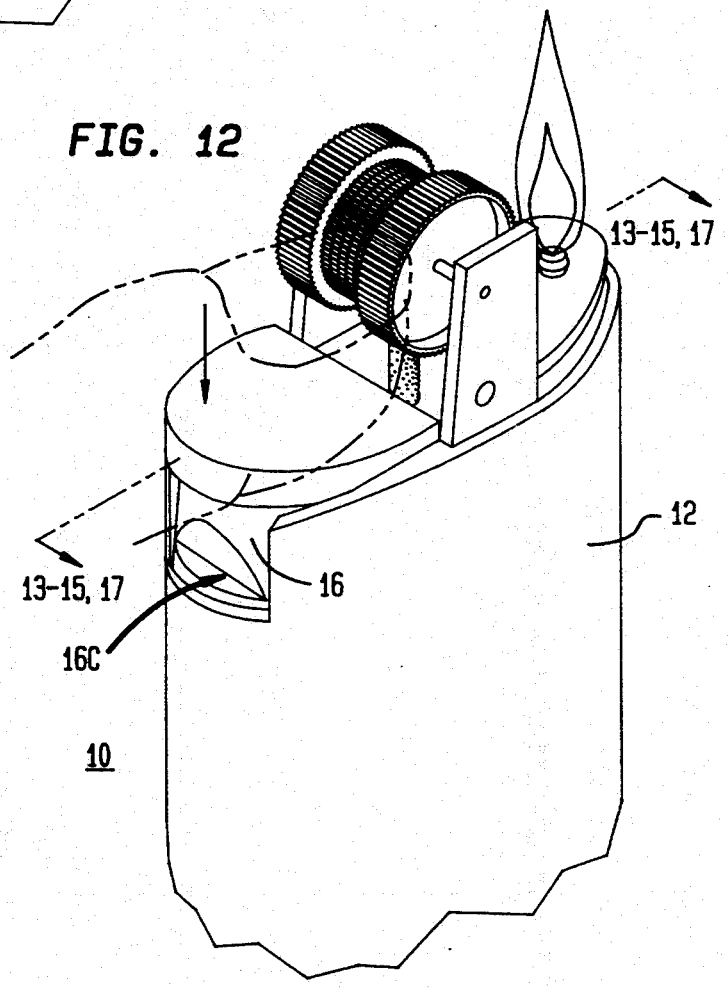

In operation of the present invention, and as depicted in FIGS. 1, 11 and 12, a user must first place the lighter in its unlatched configuration. Specifically, a user must move latch 16 inward and pivot the latch downward (FIG. 11) so as to sufficiently displace interfering portion 16B of latch 16 out of interference with interfering portion 12B of housing 12. Such movement illustratively comprises moving latch 16 so as to move interfering portion 16B of latch 16 into cavity 27 in housing 12 so as to ultimately permit depression and downward movement of valve actuator 14. Such movement of latch 16 places the lighter in an unlatched configuration as depicted in FIG. 11. Depression of valve actuator 14 at this point and suitable rotation of the spark-producing wheel assembly 18 will cause the lighter to operate, and will also cause valve actuator 14 to travel downward as indicated in FIG. 12. In particular, the sparks thus produced will ignite the gaseous fuel which is permitted to be expelled from the fuel nozzle when valve actuator 14 lifts the nozzle thereby actuating the valve. The lifting action of valve actuator 14 in a vicinity near the nozzle releases fuel from the fuel chamber thereby permitting the flow of fuel as a gaseous medium through the nozzle and the subsequent burning of such fuel.

Thus, the presently preferred embodiment of the invention may be placed in an unlatched configuration from its default latched configuration by sufficiently displacing interfering portion 16B relative to interfering portion 12B. This may be accomplished by moving interfering portion 16B into engagement with cavity 27. Advantageously, the path defined by such movement is the same for right-handed and left-handed users, and each of such users may unlatch the lighter with the same relative ease. Thus, the lighter of the present invention enables every user, whether right-handed or left-handed, to actuate the lighter by suitably urging the latch out of interference with the lighter body, and does not require separate paths or structures to accommodate right-handed and left-handed users.

More specifically, by providing a single path for latch 16 to follow as the lighter is reconfigured from the latched configuration to the unlatched configuration, which path does not favor either of right-handed or left-handed users more than the other, although both such users employ the same path, such users will feel equally comfortable in actuating the lighter without detracting from the effectiveness of the lighter's latch.

Figure 13:
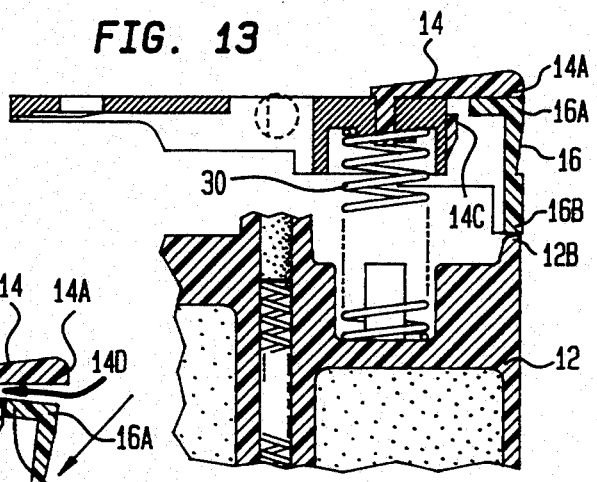
Figure 14:
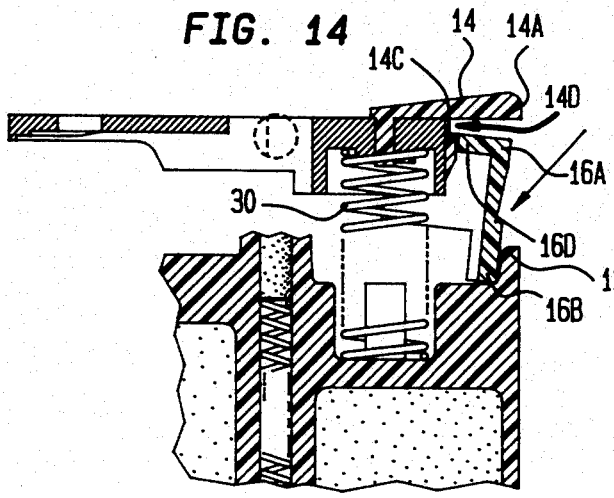

FIGS. 13–17 depict the sequence of operations required for the unlatching of the lighter by positioning interfering portion 16B of latch 16 out of interference with interfering portion 12B of housing 12. In particular, FIG. 13 depicts latch 16 and valve actuator 14 in the default or latched configuration. As will be appreciated, each of FIGS. 6 and 13 depict the latch and the valve actuator in the same latched configuration. In this configuration, depression of valve actuator 14 by finger pressure on surface 31 is prevented by the contact between interfering portion 14A of valve actuator 14 and interfering portion 16A of latch 16 as well as the contact between interfering portion 16B of latch 16 and interfering portion 12B of housing 12. As depicted in FIG. 13, valve actuator 14 and latch 16 are prevented from any further downward movement since interfering portion 16B of latch 16 abuts interfering portion 12B of body 12, except for a small gap thereinbetween. For ease of illustration, the gap between portions 16B and 12B in the figures is not necessarily drawn to scale. Additionally, such a gap is not necessary for proper operation of the invention.

FIG. 14 depicts latch 16 and valve actuator 14 in an unlatched configuration ready for depression of valve actuator 14. As will be appreciated, each of FIGS. 7 and 14 depict the latch and valve actuator in the same unlatched configuration. Latch 16 and, in particular, its interfering portion 16B has been moved inward and downward as indicated by the arrow to a position out of alignment with housing interfering portion 12B. Illustratively, interfering portion 16B has been moved into engagement with cavity 27 which is illustratively formed in housing 12. Such inward and downward movement of latch interfering portion 16B is the result of inward movement of latch 16, and pivotal downward movement of latch 16 about the points of contact between the two protrusions of latch retaining means 39 and valve actuator 14. Such points of contact are within channels 37 formed in valve actuator 14. As depicted in FIG. 14, latch 16 is incapable of further inward movement due to the contact between latch engagement portion 16D and valve actuator portion 14C.

As described in conjunction with FIG. 7, the valve actuator exerts a biasing force on the latch which, absent other forces, would tend to move the latch out of its unlatched position. However, the unlatched configuration depicted in FIG. 14 is indeed self-maintained, due to the frictional forces between the latch and the housing in the general vicinity of latch interfering portion 16B and housing interfering portion 12B. Accordingly, removal of holding pressure from finger actuatable portion 16C of latch 16 will not result in latch 16 slipping toward its latched position but will maintain the lighter in the unlatched configuration depicted in FIG. 14, until valve actuator 14 is depressed. In other words, the lighter may be readied for actuation and flame production by applying suitable force to finger actuatable portion 16C to move interfering portion 16B of latch 16 inward and downward so that portion 16B no longer interferes with housing portion 12B.

Figure 15:
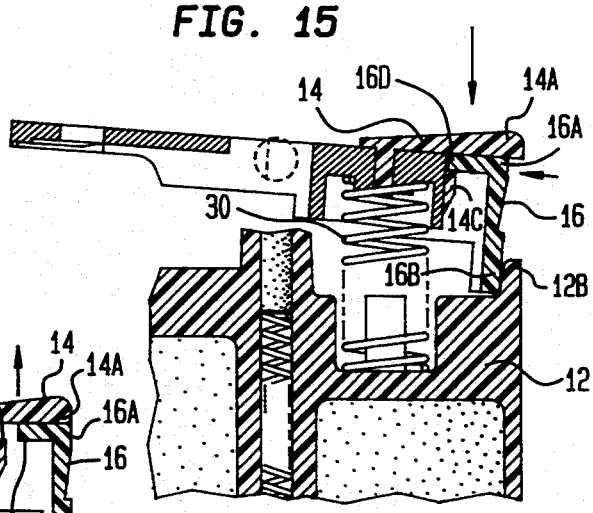
Figure 16:
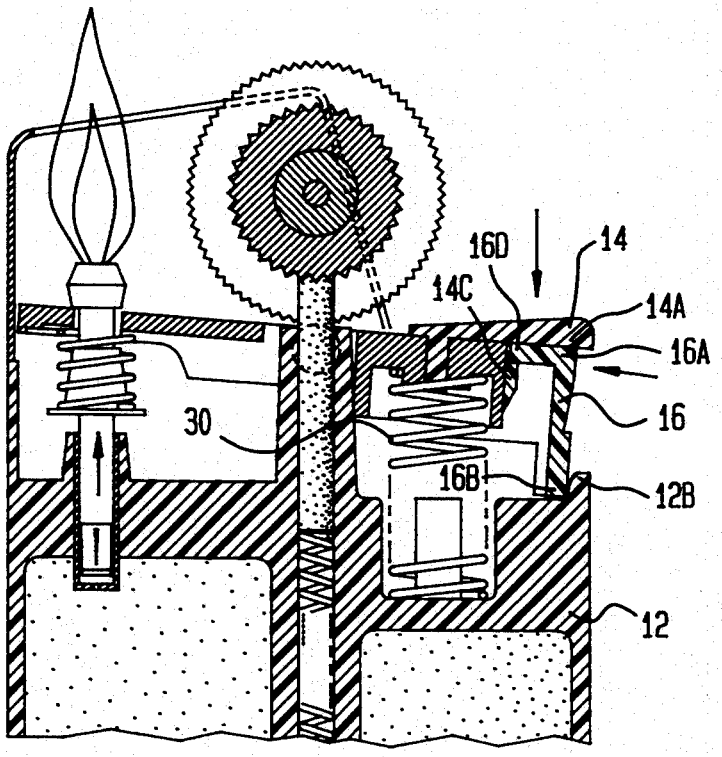

Application of finger pressure to the finger depressible surface of valve actuator 14 as depicted in FIG. 14 will yield the configuration depicted in FIG. 15 in which valve actuator 14 has been depressed thereby permitting fuel to flow through the valve and the fuel nozzle (not shown). As will be appreciated, each of FIGS. 8, 15 and 16 depict the latch and valve actuator in the same respective positions in which latch engagement portion 16D engages and indent 14D formed in valve actuator 14. In particular, and as more clearly depicted in FIG. 16, depression of valve actuator 14 will cause compression of spring 30 and urging of fuel nozzle 20 upward and partially out of valve housing 28 and body portion 12. Such lifting of fuel nozzle 20 upward will permit fuel to flow from chamber 15 through the valve and out of nozzle 20 whereupon it will have been ignited by sparks produced by flint 22 and toothed surface 19 of spark-producing assembly wheel 18. Such fuel will continue to flow and burn as long as sufficient pressure is maintained on valve actuator 14. The downward movement of valve actuator 14 is limited by its contact with latch 16 as well as by latch interfering portion 16B contacting a portion of housing 12 in the general vicinity of cavity 27 and adjacent to housing interfering portion 12B, as depicted in FIGS. 15 and 16.

As described in conjunction with FIGS. 7, 8 and 14, the valve actuator exerts a biasing force on the latch which tends to move the latch outward. However, in the configuration depicted in FIG. 15, such outward movement is limited by the contact between latch 16 and housing 12 in the general vicinity of cavity 27 and housing portion 12B.

As seen in FIGS. 15 and 16, depression of valve actuator 14 urges the valve actuator downward until its interfering portion 14A contacts latch interfering portion 16A, whereupon further downward movement is prevented. At this point, latch engagement portion 16D engages valve actuator indent 14D. As long as valve actuator 14 remains depressed, outward movement of latch 16 is limited by the contact between latch 16 and housing 12 in the general vicinity of portions 12B and 16B.

Figure 17:
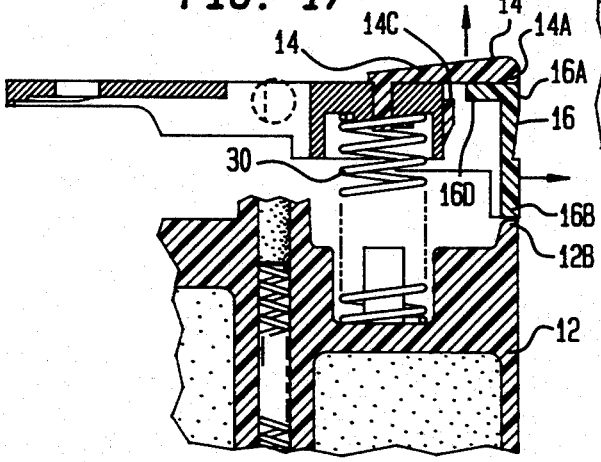

As depicted in FIG. 17, once pressure is removed from valve actuator 14, the valve actuator will move upward due to the biasing force provided by spring 30, and the flame will be extinguished. Advantageously, as valve actuator 14 moves upward, it pulls latch 16 upward due to latch engagement portion 16D being within indent 14D. As described in conjunction with FIG. 15, outward movement of latch 16 is limited by its contact with housing 12. However, as valve actuator 14 moves upward and pulls latch 16 along with it, interfering portion 16B of latch 16 also moves upward. Such upward movement of latch 16, combined with the biasing force described in conjunction with FIGS. 7, 8, 14 and 15, eventually moves latch 16 outward to the position depicted in FIG. 17. Accordingly, latch 16 will enter its fully latched position only when the valve actuator is moved fully upward thus enabling the latch to move fully outward. As described in conjunction with FIGS. 6–8, the relative shapes, materials and configurations of valve actuator 14 and latch 16 cause actuator 14 to force latch 16 fully outward. As will be appreciated, latch 16 must be forced sufficiently far outward (FIG. 17) such that latch interfering portion 16B remains in its interference position absent application of a suitable user applied force. As will also be appreciated, latch engagement portion 16D, valve actuator indent 14D and valve actuator portion 14C are configured, positioned and adapted so as to enable a user to unlatch the lighter without latch engagement portion 16D entering valve actuator indent 14D.

While FIGS. 1–8 and 11–17 depict the lighter of the present invention with one embodiment of a valve actuator and latch means that operates by moving a latch inward and downward, FIGS. 18–32 depict the lighter of the present invention with an alternative embodiment of the valve actuator and latch means that operates by moving a latch inward and upward.

Figure 18:
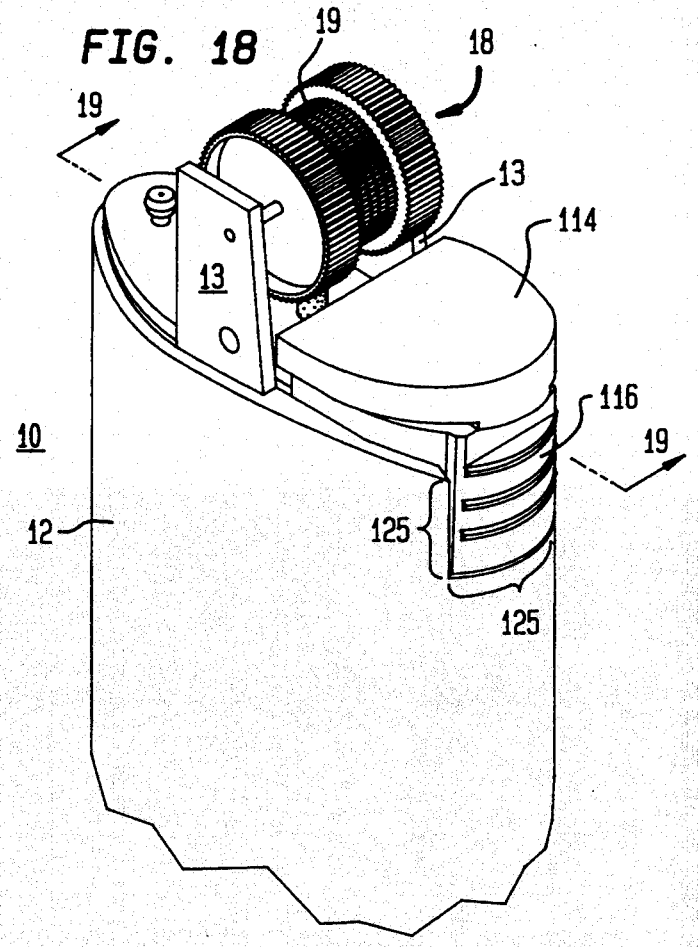

More specifically, FIG. 18 depicts a lighter similar in structure to that depicted in FIG. 1 except for valve actuator 114, latch means 116 and notched opening 125. The lighter of FIG. 18 is depicted in its default or at-rest configuration. The default configuration is also a latched configuration in which valve actuator 114 cannot be depressed due to the interference presented by latch 116. Unless latch 116 is positioned away from its depicted at-rest position and into a non-interfering position, any attempted depression of valve actuator 114 will not result in the flow of fuel and the lighter will be inoperable. The position of latch 116 as shown in FIGS. 18 and 19 may best be characterized as a "default position" under normal conditions.

Figure 19:
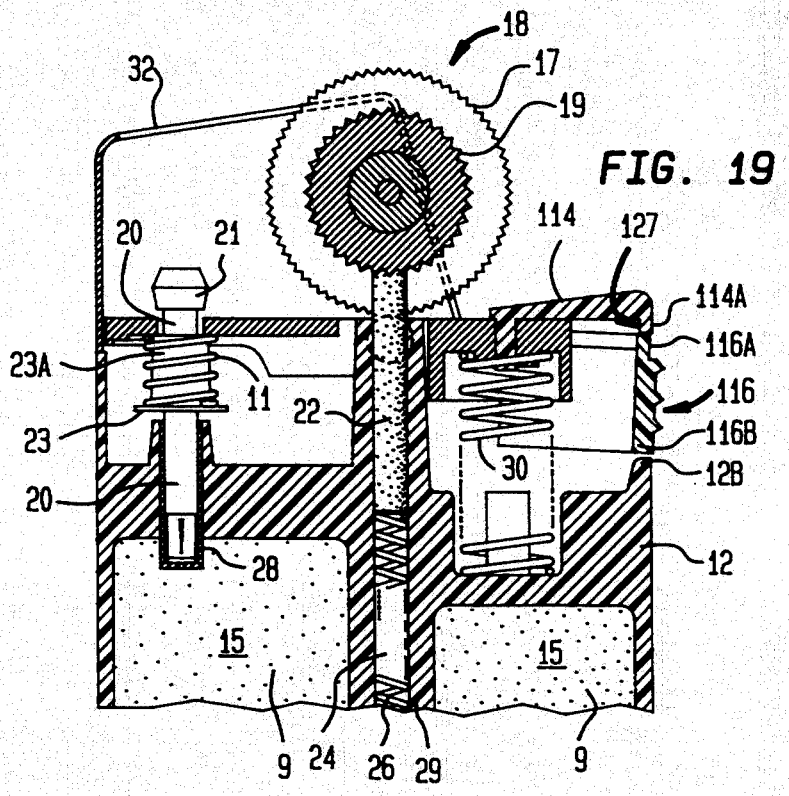

Referring now to FIG. 19, there is depicted a cross-section of the lighter of FIG. 18 in a latched configuration. Valve actuator 114 is mounted to housing 12 in a manner similar to that of valve actuator 14. Valve actuator 14 lifts fuel nozzle 20 in a manner similar to that described in conjunction with FIG. 1. Notched opening 125 is provided in body portion 12 to accommodate valve actuator 114 and latch 116 and, in particular, vertical movement of valve actuator 114 and latch 116.

Latch 116 is depicted in FIG. 19 in its latched configuration in which an interfering portion 116A of latch 116 is positioned and configured so as to interfere with and prevent depression of valve actuator 114. More specifically, an interfering portion 114A of valve actuator 114 contacts interfering portion 116A of latch 116 upon attempted depression of valve actuator 114, thus preventing the escape of fuel from fuel nozzle 20 and also preventing operation of the lighter. In its latched configuration, latch 116 is prevented from any downward travel by the contact between interfering portion 116B of latch 116 and interfering portion 12B of main body 12. Alternatively, any such downward travel of valve actuator 114 may be prevented by another portion of latch 116 contacting another portion of body 12 or another portion of latch 116 contacting another portion of valve actuator 114. As will be discussed in detail in conjunction with FIGS. 28–32, latch 116 is movable inward and upward whereupon latch interfering portion 116A is no longer aligned with valve actuator interfering portion 114A. Specifically, latch interfering portion 116A is moved inward and upward at least partially into a notch or cavity 127 suitably shaped for receiving a portion of latch 116 including a tip portion which in turn includes interfering portion 116A. Preferably, cavity 127 is shaped so as to accommodate the tip portion of latch 116, including interfering portion 116A. A user desiring to actuate the lighter must first force the tip portion of latch 116, and thus interfering portion 116A, out of interference with interfering portion 114A of latch 114. This is accomplished by a user moving latch 116 inward and upward such that interfering portion 116A is moved at least partially into cavity 127. Once a user moves latch 116 sufficiently inward and upward into its unlatched position, the latch will remain in its unlatched position until a user depresses and releases the valve actuator.

Figure 20:
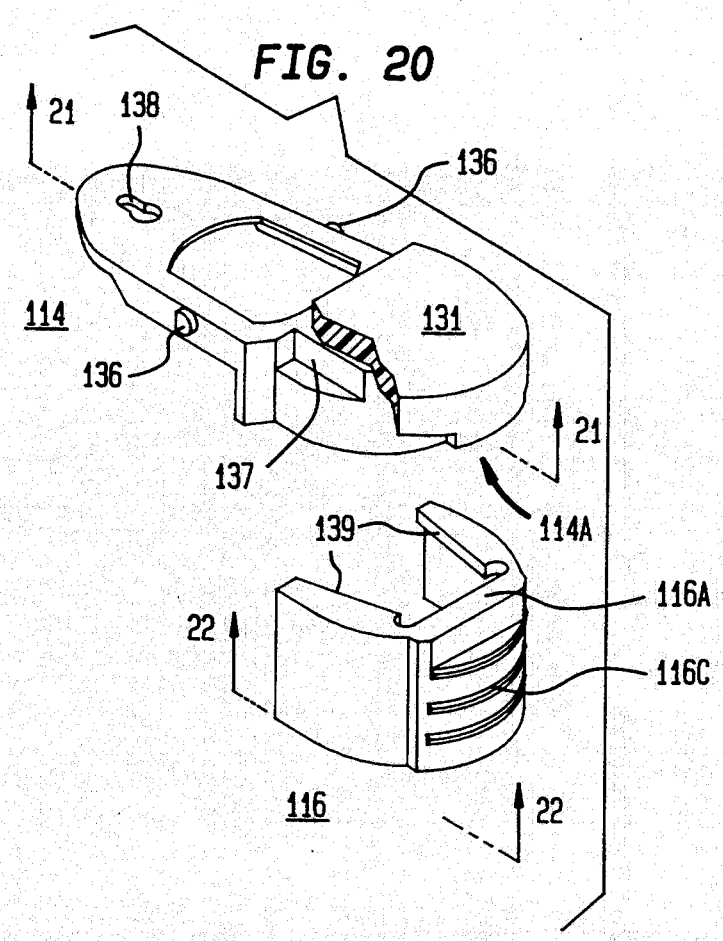

Referring now to FIG. 20, there is depicted valve actuator 114 and latch 116 in greater detail. Valve actuator 114 comprises a finger depressible surface 131, extensions 136, a bore 138, and retaining means 137. Such retaining means illustratively comprises two channels, one located on each of two sides of the valve actuator. Items 131, 136, and 138 are structured and operate similar to items 31, 36 and 38 of FIGS. 1–8 and 11–17.

Figure 28:
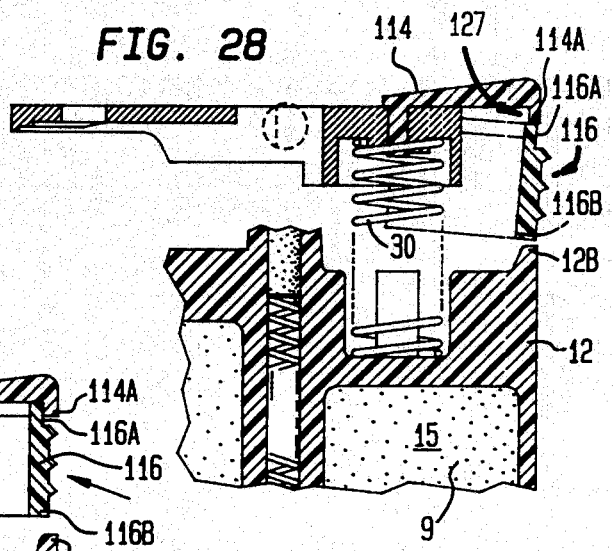
Figure 29:
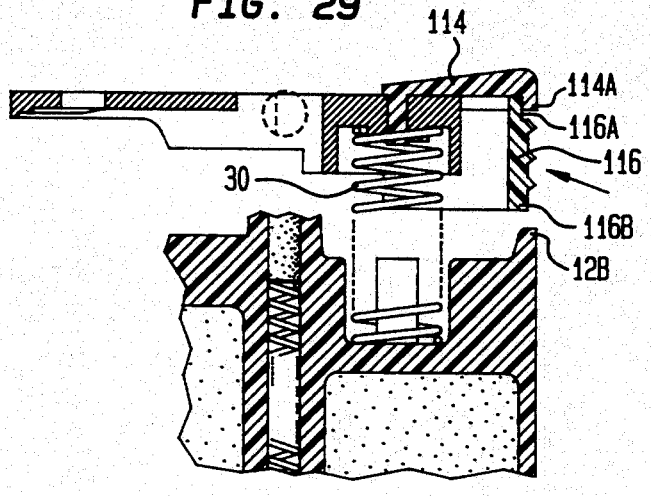

Latch 116 includes retaining means 139. Illustratively, such retaining means 139 comprises two elongated members, one located on respective inner surfaces of each of two sides of the latch. Such retaining means 139 is shaped, configured, positioned and adapted to enable latch 116 to slide within channels 137 (as best depicted in FIGS. 23–25 and 28–32) as well as to enable latch 116 to pivot upward about pivot points within channels 137 (as best depicted in FIGS. 28–29).

More specifically, latch 116 is slideably attached to valve actuator 114 by way of channels 137 formed in actuator 114 and elongated members 139 formed in latch 116. Such slideable attachment enables latch 116 to move inward and outward relative to valve actuator 114. Additionally, the size, shape, position and configuration of retaining means 137 and 139 facilitate retention of means 139 within means 137 while permitting means 139 to slide within means 137 and permitting limited pivotal movement of the latch relative to the valve actuator. As will be described in conjunction with FIGS. 30–32, such limited pivotal movement enables the valve actuator to pull the latch upward after the valve actuator has been depressed and released.

As will be appreciated, retaining means 137 and retaining means 139 may take on a variety of shapes, positions and configurations. Their specific structure is not critical to the present invention. Additionally, each of retaining means 137 and 139 can comprise any reasonable number (including one) of separate structures.

Valve actuator 114 and latch 116 are preferably constructed from the same materials as valve actuator 14 and latch 16, respectively.

In the latched or closed configuration (FIGS. 18 and 19), an upper surface of interfering portion 116A of latch 116 abuts a lower surface of interfering portion 114A of valve actuator 114, and a lower surface of interfering portion 116B of latch 116 abuts an upper surface of interfering portion 12B of body 12, thereby preventing depression of valve actuator 114. Alternatively, a small gap (FIGS. 18 and 19) may be provided between latch 116 and valve actuator 114, or between latch 116 and housing 12.

Figure 21:
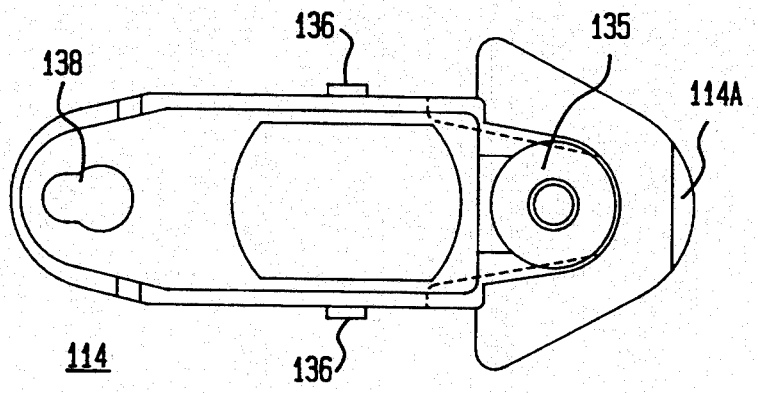

Referring now to FIG. 21, there is depicted a view of the underside of valve actuator 114 of FIG. 20. A portion 135 of valve actuator 14 is adapted to receive spring 30 as depicted in FIG. 19.

Figure 22:
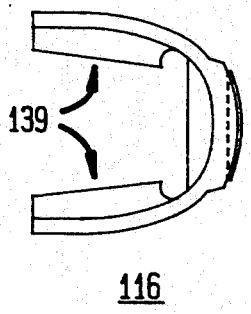

FIG. 22 depicts the underside of latch 116 of FIG. 20. The size, shape, and configuration of latch 116 facilitates retention of the lighter in an unlatched configuration as well as stabilization of latch 116 within the lighter. Finger actuatable portion 116C of latch 116 is employed by a user to move the latch and, in particular, is preferably employed by a user's fingertip to move latch interfering portion 116A inward and upward out of interference with valve actuator interference portion 114A.

Figure 23:
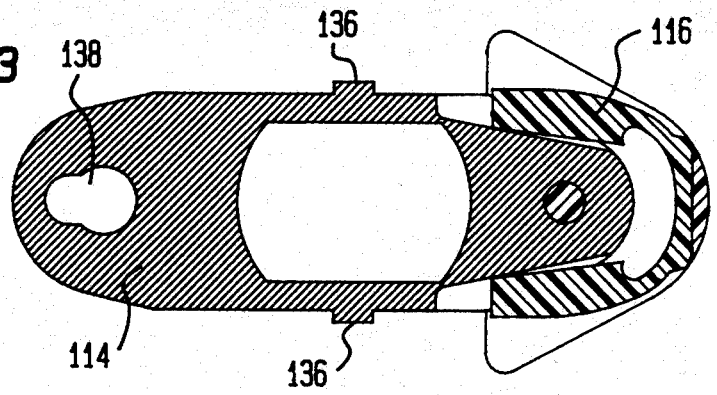
Figure 24:
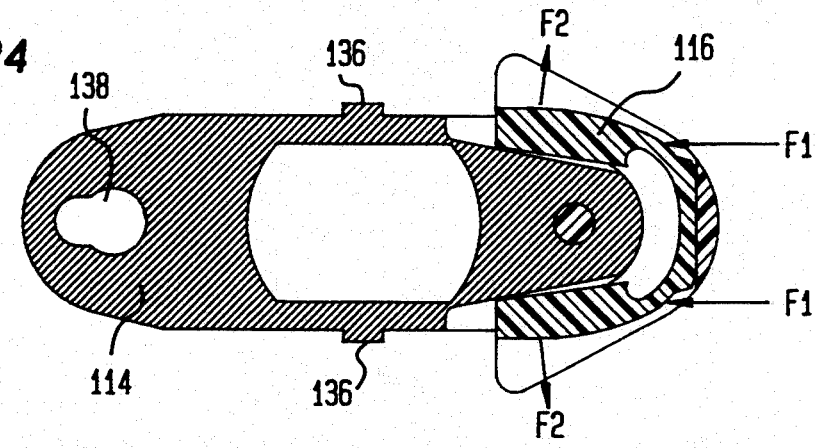
Figure 25:
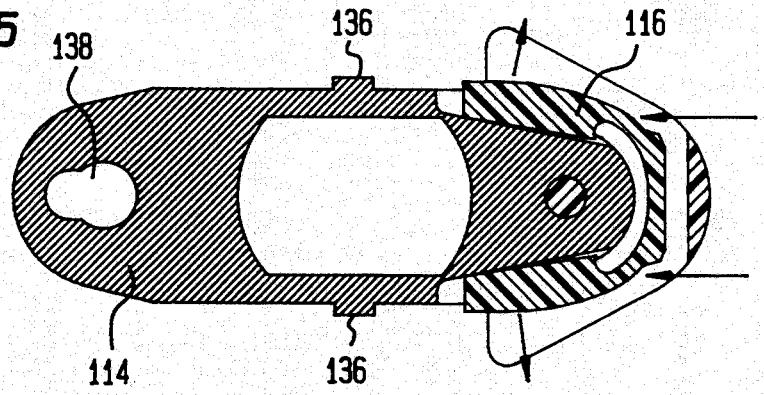

FIGS. 23, 24 and 25 are each cross-sectional views of the valve actuator and latch of FIG. 20 when in their latched (FIG. 23), unlatched (FIG. 24) and intermediate (FIG. 25) configurations. More specifically, FIG. 23 depicts latch 116 in its latched position in which latch retaining means 139 is maintained in valve actuator channels 137 in their at rest or latched positions. As will be appreciated, latch 116 is preferably under no loading as it is depicted in FIG. 23.

FIG. 24 depicts latch 116 in its unlatched position in which latch 116 is moved inward (F1) and upward. As will be appreciated, valve actuator 114 exerts force on latch retaining means 139 when in the latched position as indicated by arrows F2. Advantageously, the lighter maintains the unlatched configuration once it is placed in such an unlatched configuration.

Advantageously, latch 16 may only be moved from its latched position (FIG. 23) to its unlatched position (FIG. 24) by external force, i.e., a force applied by a user to latch 116. Accordingly, absent the application of such force, the lighter of the present invention is normally maintained in its latched configuration.

For the same reasons as described in conjunction with FIG. 7, the valve actuator of FIG. 24 exerts a biasing force on the latch which tends to force the latch outward, in a direction opposite that indicated by arrows F1 in FIG. 24.

Referring now to FIG. 25, valve actuator 114 and latch 116 are depicted in a configuration which is timewise intermediate the unlatched configuration of FIG. 24 and the latched configuration of FIG. 23. As depicted in FIG. 25, latch 116 is under loading and is temporarily deformed. The configuration depicted in FIG. 25 occurs for a brief period of time as valve actuator 114 is depressed and moved downward along with latch 116 thereby forcing latch 116 further inward relative to actuator 114. As will be described in conjunction with FIGS. 30 and 31, a portion of housing 12 in the general vicinity of interfering portion 12B forces latch 116 further inward relative to the valve actuator when the valve actuator is fully depressed.

As will be appreciated, the materials and configurations of valve actuator 114 and latch 116 as well as their shapes cause valve actuator 114 to force latch 116 away from actuator 114 for all positions of the latch, except for its latched position, thereby biasing the latch toward its latched position once it becomes disengaged from the actuator.

Figure 26:
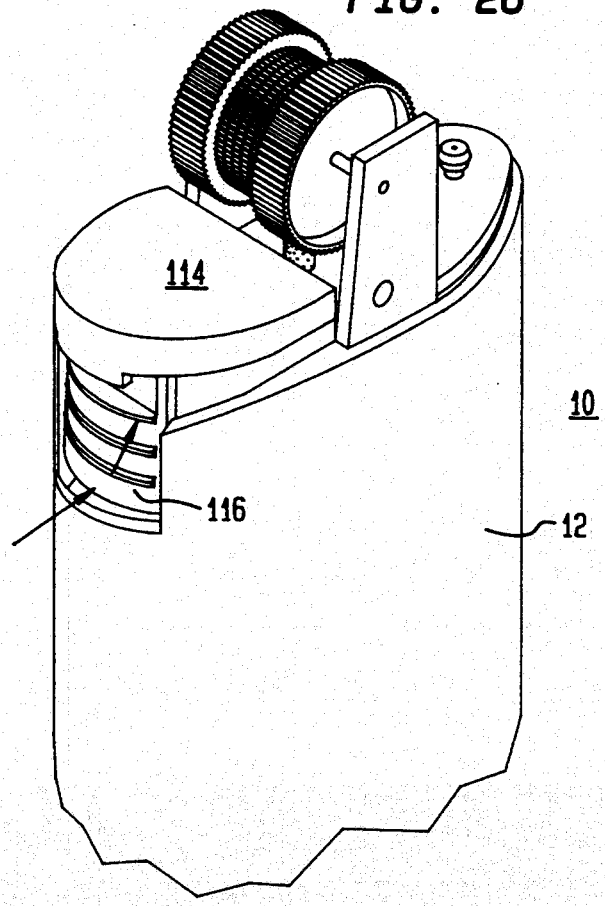
Figure 27:
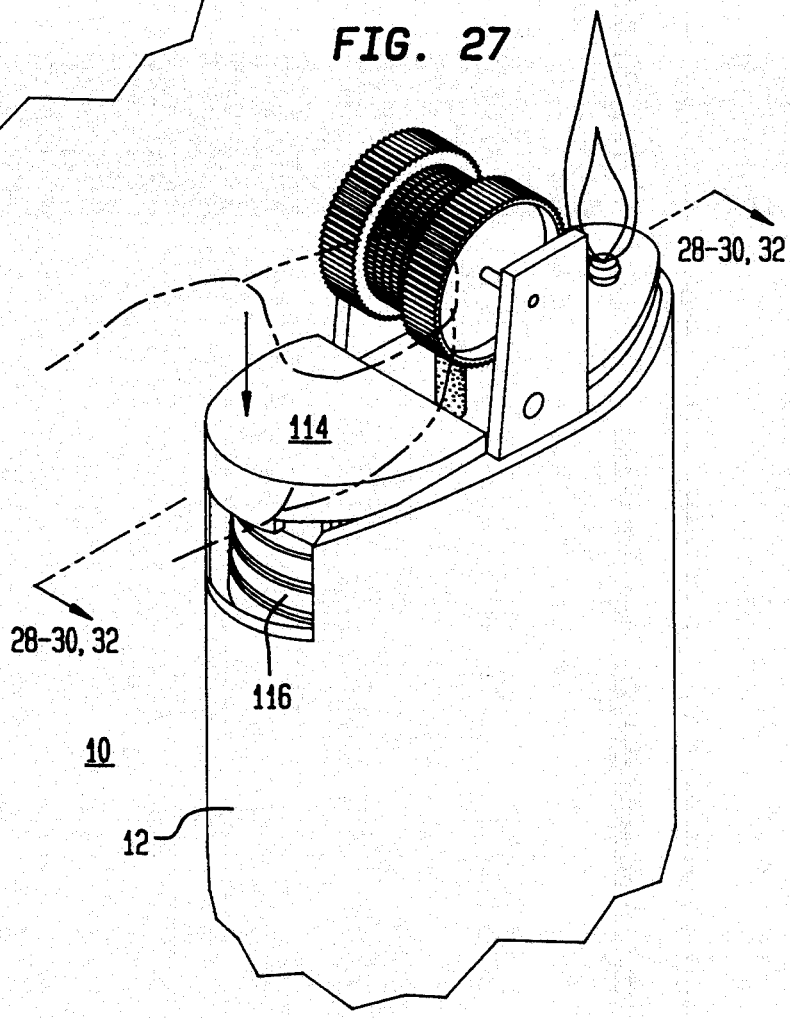

In operation of the present invention as set forth in FIGS. 18–32, a user must first place the lighter in its unlatched configuration. Specifically, a user must move latch 116 inward and pivot the latch upward (FIG. 26) so as to sufficiently displace interfering portion 116A of latch 116 out of interference with interfering portion 114A of valve actuator 114. Such movement illustratively comprises moving latch 116 so as to move interfering portion 116A of latch 116 into cavity 127 in valve actuator 114 so as to ultimately permit depression and downward movement of valve actuator 114 as well as latch 116. Such movement of latch 116 places the lighter in an unlatched configuration as depicted in FIG. 26. Depression of valve actuator 114 at this point and suitable rotation of the spark-producing wheel assembly 18 will cause the lighter to operate, and will also cause valve actuator 114 and latch 116 to travel downward as indicated in FIG. 27.

FIGS. 28–32 depict the sequence of operations required for the unlatching of the lighter by positioning interfering portion 116A of latch 116 out of interference with interfering portion 114A of valve actuator 114. In particular, FIG. 28 depicts latch 116 and valve actuator 114 in the default or latched configuration. As will be appreciated, each of FIGS. 23 and 28 depict the latch and the valve actuator in the same latched configuration. In this configuration, depression of valve actuator 114 by finger pressure on surface 131 is prevented by the contact between interfering portion 114A of valve actuator 114 and interfering portion 116A of latch 116 as well as the contact between interfering portion 116B of latch 116 and interfering portion 12B of housing 12.

FIG. 29 depicts latch 116 and valve actuator 114 in an unlatched configuration ready for depression of valve actuator 114. As will be appreciated, each of FIGS. 24 and 29 depict the latch and valve actuator in the same unlatched configuration. Latch 116 and, in particular, its interfering portion 116A has been moved inward and upward as indicated by the arrow to a position out of alignment with interfering portion 114A. Illustratively, interfering portion 116A has been moved into engagement with cavity 127 which is illustratively formed in valve actuator 114. Such inward and upward movement of latch interfering portion 116A is the result of inward movement of latch 116, and pivotal upward movement of latch 116 about the points of contact between the two elongated members of latch retaining means 139 and valve actuator 114. Such points of contact are within channels 137 formed in valve actuator 114.

As previously described, the valve actuator exerts a biasing force on the latch which, absent other forces, would tend to move the latch out of its unlatched position. However, the unlatched configuration depicted in FIG. 29 is indeed self-maintained, due to the frictional forces between the latch and the valve actuator in the general vicinity of latch interfering portion 116A and valve actuator interfering portion 114A. Accordingly, removal of holding pressure from finger actuatable portion 116C of latch 116 will not result in latch 116 slipping toward its latched position but will maintain the lighter in the unlatched configuration depicted in FIG. 29, until valve actuator 114 is depressed.

Figure 30:
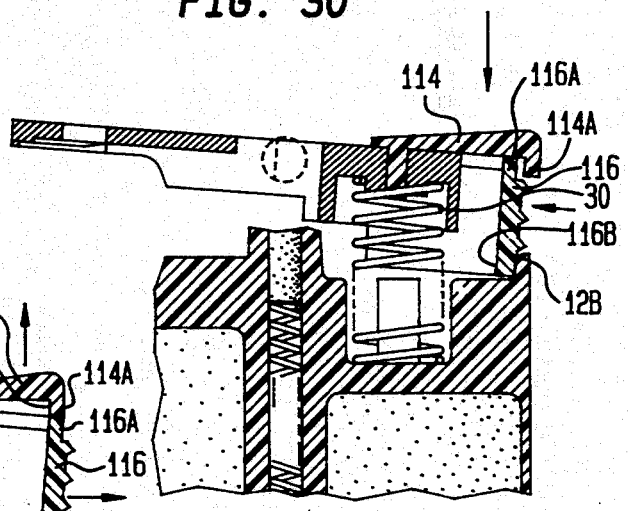
Figure 31:
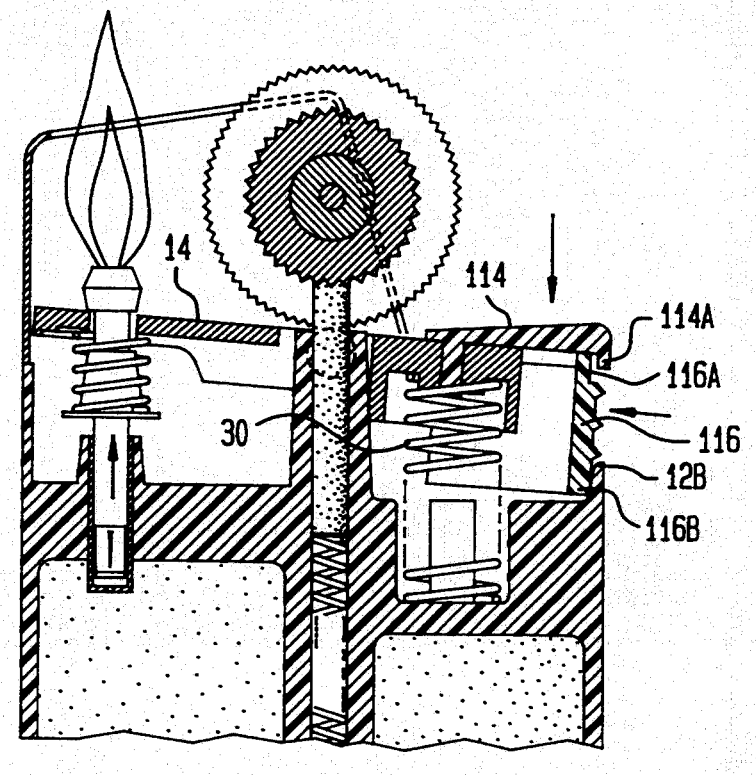

Application of finger pressure to the finger depressible surface of valve actuator 114 as depicted in FIG. 29 will yield the configuration depicted in FIG. 30 in which valve actuator 114 has been depressed thereby permitting fuel to flow through the valve and the fuel nozzle (not shown). As will be appreciated, each of FIGS. 25, 30 and 31 depict the latch and valve actuator in the same respective positions. In particular, and as more clearly depicted in FIG. 31, depression of valve actuator 114 will cause downward movement of valve actuator 114 and latch 116. Such downward movement is limited by the contact between latch interfering portion 116B and a portion of housing 12 in the general vicinity of housing interfering portion 12B, as depicted in FIGS. 30 and 31.

As described in conjunction with FIGS. 24, 25 and 29, the valve actuator exerts a biasing force on the latch which tends to move the latch outward. However, in the configuration depicted in FIG. 30, such outward movement is limited by the contact between latch 116 and housing 12 in the general vicinity of housing portion 12B.

As seen in FIGS. 30 and 31, depression of valve actuator 114 urges the valve actuator and latch downward until latch interfering portion 116B contacts housing 12, whereupon further downward movement is prevented. Additionally, as latch 116 moves downward, latch interfering portion 116B contacts housing interfering portion 12B which is preferably slanted so as to cam or force latch 116 further inward as the latch is moved fully downward, thereby relieving the pressure between latch 116 and valve actuator 114 in the general vicinity of latch interfering portion 116A and valve actuator interfering portion 114A. As long as valve actuator 114 remains depressed, outward movement of latch 116 is limited by the contact between latch 116 and housing 12 in the general vicinity of portions 12B and 116B.

Figure 32:
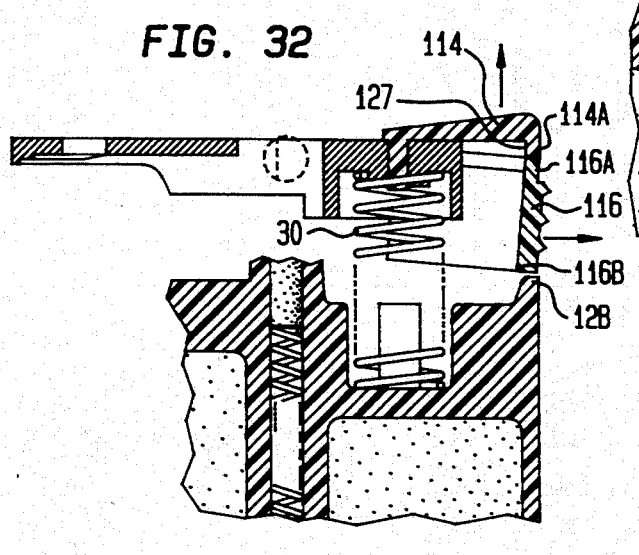

As depicted in FIG. 32, once pressure is removed from valve actuator 114, the valve actuator will move upward due to the biasing force provided by spring 30, and the flame will be extinguished. Advantageously, as valve actuator 114 initially moves upward, it moves away from latch 116 in the general vicinity of latch portion 116A and valve actuator portion 114A. Specifically, latch 116 initially stays in its downward position (FIG. 30) due to the frictional forces between the latch and the housing in the general vicinity of latch portion 116B and housing portion 12B. During such initial movement, the valve actuator pivots with respect to the latch. However, as valve actuator 114 moves sufficiently far upward, a point is reached at which further pivotal movement is prevented due to the positioning of latch retaining means 139 within valve actuator retaining means 137. Accordingly, as actuator 114 moves still further upward, it pulls latch 116 along with it.

As described in conjunction with FIG. 30, outward movement of latch 116 is limited by its contact with housing 12. However, as valve actuator 114 moves upward and pulls latch 116 along with it, interfering portion 116B of latch 116 also moves upward, sliding over the slanted portion of housing 12 in the general vicinity of portion 12B. Such upward movement of latch 116, combined with the biasing force described in conjunction with FIGS. 24, 25, 29 and 30, eventually moves latch 16 outward to the position depicted in FIG. 32. Accordingly, latch 116 will enter its fully latched position only when the valve actuator is moved fully upward thus enabling the latch to move fully outward. As previously described, the relative shapes, materials and configurations of valve actuator 114 and latch 116 cause actuator 114 to force latch 116 fully outward. As will be appreciated, latch 116 must be forced sufficiently far outward (FIG. 32) such that the latch remains in its interference position absent application of a suitable user applied force.

While it is apparent that the invention herein disclosed is well-calculated to fulfill the objects above stated, it will be appreciated that numerous modifications and embodiments may be devised by those skilled in the art, and it is intended that the appended claims cover all such modifications and embodiments as fall within the true spirit and scope of the present invention.

More specifically, the latch means and lighter disclosed and claimed herein are not limited to use in disposable lighters. Moreover, the present invention is not limited to a latch means in which a latch is moved first in an inward direction then in an upward direction ninety degrees from the inward direction, or first in an inward direction then in a downward direction ninety degrees from the inward direction. Similarly, the latch may be positioned at other locations within the lighter body so as to prevent depression of the valve actuator by interfering with other portions of the valve actuator.

We claim:

1. A flame producing lighter resistant to unauthorized use and normally maintained in a latched configuration comprising:

a housing having a fuel reservoir;

fuel supply means for supplying fuel to be ignited from said fuel reservoir;

ignition means for igniting said fuel;

valve means for controlling the flow of said fuel;

a valve actuator which normally prevents the flow of said fuel when said valve actuator is in a first position and which is depressible along a longitudinal axis of said housing to a second position which permits actuation of said fuel supply means thereby permitting fuel to flow out from said fuel supply means;

a latch positioned so as to normally prevent depression of said valve actuator and normally maintain said lighter in said latched configuration;

wherein inward movement of said latch towards the longitudinal axis of said housing enables an interfering portion of said latch to become aligned with a cavity in said valve actuator, said cavity being sufficient in size to accommodate said interfering portion so as to enable said valve actuator to be depressed, and wherein upward movement of said latch along the longitudinal axis of said housing, subsequent to said inward movement, causes said aligned interfering portion of said latch to enter said cavity and places said lighter in an unlatched configuration in which said valve actuator is capable of being depressed, thereby permitting fuel to flow.

2. The flame producing lighter according to claim 1 wherein said ignition means comprises a spark-producing wheel and a flint urged against said wheel and wherein sparks are produced by rotation of said wheel.

3. The flame producing lighter according to claim 1 wherein said ignition means comprises electric spark-producing means.

4. The flame producing lighter according to claim 1 wherein said ignition means comprises piezoelectric spark-producing means.

5. The flame producing lighter according to claim 1 wherein said latch is constrained to move along only a single path when said lighter is configured from said latched configuration to said unlatched configuration.

6. The flame producing lighter according to claim 1 wherein said unlatched configuration is resiliently maintained.

7. A flame producing lighter resistant to unauthorized use and normally maintained in a latched configuration comprising:

a housing having a fuel supply means for supplying fuel to be ignited;

ignition means for igniting said fuel;

valve means for controlling the flow of said fuel;

a valve actuator which normally prevents the flow of said fuel when in a first position and is depressible to a second position along a longitudinal axis of said housing which permits actuation of said fuel supply means thereby permitting fuel to flow out from said fuel supply means;

a latch positioned so as to normally prevent depression of said valve actuator and normally maintain said lighter in said latched configuration;

wherein inward movement of said latch towards the longitudinal axis of said housing enables an interfering portion of said latch to become aligned with a cavity in said housing, said cavity being sufficient in size to accommodate said interfering portion so as to enable said valve actuator to be depressed, and wherein downward movement of said latch along the longitudinal axis of said housing, subsequent to said inward movement, causes said aligned interfering portion of said latch to enter said cavity and places said lighter in an unlatched configuration in which said valve actuator is capable of being depressed, thereby permitting fuel to flow.

8. The flame producing lighter according to claim 7 wherein said ignition means comprises a spark-producing wheel and a flint urged against said wheel and wherein sparks are produced by rotation of said wheel.

9. The flame producing lighter according to claim 7 wherein said ignition means comprises electric spark-producing means.

10. The flame producing lighter according to claim 7 wherein said ignition means comprises piezoelectric spark-producing means.

11. The flame producing lighter according to claim 7 wherein said latch is constrained to move along only a single path when said lighter is configured from said latched configuration to said unlatched configuration.

12. The flame producing lighter according to claim 7 wherein said unlatched configuration is resiliently maintained.

13. A flame producing lighter which comprises:

a housing defining a reservoir for containing a combustible gaseous medium under pressure;

valve means operatively engaged with said reservoir for releasing the gaseous medium;

means mounted for selective actuation of said valve means between a normally closed position which prevents exit of said gaseous medium from said reservoir, and an open position which permits exit of said gaseous medium from said reservoir through said valve means;

means for selectively producing sparks at a location proximate the gaseous medium exit opening of said valve means thereby selectively causing ignition of said gaseous medium; and a latch slideably and pivotally, mounted to said means for selective actuation, said latch having a finger actuatable portion and an interfering portion connected thereto, said latch being positioned so as to interfere with the movement of said means for selective actuation along a longitudinal axis of said housing for preventing actuation of said valve means to the open position, said finger actuatable portion being movable inward towards and downward along the longitudinal axis of said housing so as to move said interfering portion out of interference and into engagement with a cavity formed in said housing.

14. The flame producing lighter according to claim 13 wherein said finger actuatable portion is constrained to move along only a single path as said interfering portion is moved out of its interference position.

15. The flame producing lighter according to claim 13 wherein said interfering portion is retained in said out of interference position until said valve means is moved to the open position and released.

16. A flame producing lighter which comprises:

a housing defining a reservoir for containing a combustible gaseous medium under pressure;

valve means operatively engaged with said reservoir for releasing fuel;

actuator means arranged for selective actuation of said valve means between a normally closed position which prevents exit of said gaseous medium from said reservoir and an open position which permits exit of gaseous medium from said reservoir through said valve means, said actuator means including a first interfering portion;

means for preventing movement of said actuator means by interfering with the movement thereof of said actuator means along a longitudinal axis of said housing, said means for preventing having a finger actuatable portion and a second interfering portion, said first and second interfering portions being normally in alignment with each other thereby preventing movement of said actuator means, said finger actuatable portion and said second interfering portion being selectively movable inward towards the longitudinal axis of said housing and then moveable in another direction so as to move said second interfering portion out of alignment with said first interfering portion, said second interfering portion being normally retained in a valve actuation interference position, the movement thereof to a position out of interference with said valve actuator means being resiliently provided so as to return said second interfering portion to its position in interference with said valve actuator when said valve actuator is released, thus preventing said valve nozzle from opening; and means for selectively producing sparks at a location proximate the gaseous medium exit opening of said valve means thereby selectively causing ignition of said gaseous medium.

17. The flame producing lighter according to claim 16 wherein said movement of said finger actuatable portion which causes said second interfering portion to move out of alignment with said first interfering portion is constrained to movement in a single path.

18. The flame producing lighter according to claim 16 wherein said another direction is in an upward direction.

19. The flame producing lighter according to claim 16 wherein said second interfering portion is retained out of alignment with said first interfering portion.

20. The flame producing lighter according to claim 16 wherein said another direction is in a downward direction.

21. A flame producing lighter which comprises:

a housing defining a reservoir for containing a combustible gaseous medium under pressure, said housing including a first interfering portion;

valve means operatively engaged with said reservoir for releasing fuel;

actuator means arranged for selective actuation of said valve means between a normally closed position which prevents exit of said gaseous medium from said reservoir and an open position which permits exit of gaseous medium from said reservoir through said valve means;

means for preventing movement of said actuator means by interfering with the movement thereof of said actuator means along a longitudinal axis of said housing, said means for preventing having a finger actuatable portion and a second interfering portion, said first and second interfering portions being normally in alignment with each other in an interfering position thereby preventing movement of said actuator means, said finger actuatable portion being selectively movable inward towards the longitudinal axis of said housing and then moveable in another direction so as to move said second interfering portion to a non-interfering position within said housing and valve actuator out of alignment with said first interfering portion, said second interfering portion being normally retained in the interfering position, the movement thereof to the non-interfering position being resiliently provided so as to return said second interfering portion to its interfering position when said valve actuator is released, thus preventing said valve nozzle from opening; and means for selectively producing sparks at a location proximate the gaseous medium exit opening of said valve means thereby selectively causing ignition of said gaseous medium.

22. The flame producing lighter according to claim 21 wherein said movement of said finger actuatable portion which causes said second interfering portion to move out of alignment with said first interfering portion is constrained to movement in a single path. direction.

23. The flame producing lighter according to claim 21 wherein said another direction is in a downward direction.

24. The flame producing lighter according to claim 21 wherein said second interfering portion is retained out of alignment with said first interfering portion.

25. The flame producing lighter according to claim 21 wherein said another direction is in an upward direction.

26. A lighter having a fuel cut-off mechanism, a fuel supply and a valve for normally preventing release of fuel, said fuel cut-off mechanism comprising:

means for selectively permitting release of said fuel including a depressible valve actuator which upon depression along a longitudinal axis of said lighter releases said fuel; and a latch having at least a portion which normally interferes with depression of said valve actuator, said latch being arranged such that inward movement towards and then downward movement along the longitudinal axis of said lighter moves said interfering portion to a non-interfering position in said lighter which enables depression of said valve actuator.

27. The fuel cut-off mechanism of claim 12 further comprising means for constraining said movement of said latch to a single path equally suitable for both right-handed and left-handed users.

28. The fuel cut-off mechanism of claim 26 further comprising means for retaining said lighter in an unlatched configuration.

29. The fuel cut-off mechanism of claim 26 wherein said portion of said latch is normally positioned between at least a portion of said valve actuator and at least a portion of a main body housing of said lighter so as to normally interfere with depression of said valve actuator.

30. A lighter having a fuel supply and a fuel cut-off mechanism, said fuel cut-off mechanism comprising:

(a) a valve to control release of fuel from the fuel supply; and (b) means for selectively permitting actuation of said valve, such selective actuation of said valve and a corresponding production of sparks by spark-producing means causing fuel from said fuel supply to be ignited, said means for selectively permitting including:

(i) a depressible valve actuator which, upon depression along a longitudinal axis of said lighter, actuates said valve thereby permitting fuel to flow out from said fuel supply;

(ii) a latch which normally prevents depression of said valve actuator, at least a portion of said latch being normally positioned in a first position between at least a portion of said valve actuator and at least a portion of a main body housing of said lighter thereby preventing depression of said valve actuator, wherein latch movement towards and downward along the longitudinal axis of said lighter toward a Second position such that said latch portion is moved out from between said actuator and body portion, said second portion being resiliently maintained to provide said lighter in an unlatched configuration in which said valve actuator is capable of being depressed, thereby permitting fuel to flow; and (iii) means for constraining said movement of said latch to a single path equally suitable for both right-handed and left-handed users.

31. A flame developing lighter comprising:

(a) a housing having fuel supply means for supplying fuel to be ignited;

(b) ignition means for igniting said fuel;

(c) valve means for selectively permitting flow of said fuel; and (d) means for selectively unlatching said lighter from a normally latched configuration in which fuel is prevented from flowing, said means for selectively unlatching including:

(i) a valve actuator which normally prevents release of fuel from said fuel supply when in a first position and is depressible along a longitudinal axis of said housing to a second position which permits release of said fuel; and (ii) a latch which normally prevents depression of said valve actuator, said latch having an interfering portion being normally positioned in alignment with an interfering portion of said valve actuator thereby preventing depression of said valve actuator, wherein inward movement of said latch interfering portion towards the longitudinal axis of said housing moves said latch interfering portion to a position out of alignment with said valve actuator interfering portion, and wherein upward movement of said latch along the longitudinal axis of said housing, subsequent to said inward movement, resiliently maintains the latch interfering portion in said position and provides said lighter in an unlatched configuration in which said valve actuator is capable of being depressed, thereby permitting fuel to flow.

32. The flame developing lighter according to claim 31 wherein said ignition means comprises a spark-producing wheel and a flint urged against said wheel and wherein sparks are produced by rotation of said wheel.

33. The flame developing lighter according to claim 31 wherein said ignition means comprises electric spark-producing means.

34. The flame developing lighter according to claim 31 wherein said ignition means comprises piezoelectric spark-producing means.

35. The flame developing lighter of claim 31 further comprising means for constraining said movement of said latch to a single path equally suitable for both right-handed and left-handed users.

36. A flame developing lighter comprising:

(a) a housing having a fuel supply means for supplying fuel to be ignited;

(b) ignition means for igniting said fuel;

(c) valve means for selectively permitting flow of said fuel; and (d) means for selectively unlatching said lighter from a normally latched configuration in which fuel is prevented from flowing, said means for selectively unlatching including:

(i) a valve actuator which normally prevents release of fuel from said fuel supply when in a first position and is depressible along a longitudinal axis of said housing to a second position which permits release of said fuel; and (ii) a latch cooperating with the valve actuator to normally prevent depression of said valve actuator, said latch having an interfering portion being normally positioned in alignment with an interfering portion of said housing thereby preventing depression of said valve actuator, wherein inward movement of said latch interfering portion towards the longitudinal axis of said housing moves said latch interfering portion out of alignment with said housing interfering portion, and wherein downward movement of said latch along the longitudinal axis of said housing, subsequent to said inward movement, resiliently maintains the latch interfering portion out of alignment with the housing interfering portion and provides said lighter in an unlatched configuration in which said valve actuator is capable of being depressed, thereby permitting fuel to flow.

37. The flame developing lighter according to claim 36 wherein said ignition means comprises a spark-producing wheel and a flint urged against said wheel and wherein sparks are produced by rotation of said wheel.

38. The flame developing lighter according to claim 36 wherein said ignition means comprises electric spark-producing means.

39. The flame developing lighter according to claim 36 wherein said ignition means comprises piezoelectric spark-producing means.

40. The flame developing lighter of claim 36 further comprising means for constraining said movement of said latch to a single path equally suitable for both right-handed and left-handed users.

41. A flame developing lighter comprising:

(a) a housing having a fuel supply means for supplying fuel to be ignited;

(b) ignition means for igniting said fuel;

(c) valve means for selectively permitting flow of said fuel; and (d) control means for preventing fuel flow and ignition, said control means including:

(i) a valve actuator which normally prevents release of said fuel from said fuel supply means when in a first position and is depressible along a longitudinal axis of said housing to a second position which permits actuation of said fuel supply means thereby permitting fuel to flow out from said fuel supply means; and (ii) a latch having an interfering portion which is normally in an interfering position thereby preventing depression of said valve actuator, wherein inward movement of said latch towards the longitudinal axis of said housing causes said interfering portion to move toward a non-interfering position and wherein further movement in another direction, subsequent to said inward movement of said latch into the non-interfering position, provides said lighter in an unlatched configuration in which said valve actuator is capable of being depressed, thereby permitting fuel to flow.

42. The flame developing lighter of claim 41 wherein said another direction is upward.

43. The flame developing lighter of claim 41 wherein said another direction is downward.

44. The flame developing lighter of claim 41 wherein movement of said latch is limited to movement in a single path.

45. A flame developing lighter comprising:

(a) a housing having fuel supply means for supplying fuel to be ignited;

(b) ignition means for igniting said fuel;

(c) valve means for selectively permitting flow of said fuel; and (d) control means for preventing fuel flow and ignition, said control means including:

(i) a valve actuator which normally prevents release of said fuel from said fuel supply means when in a first position and is depressible along a longitudinal axis of said housing to a second position which permits actuation of said fuel supply means thereby permitting fuel to flow out from said fuel supply means; and (ii) a latch having an interfering portion which is normally in an interfering position thereby preventing depression of said valve actuator, wherein movement of said latch in a first direction followed by movement of said latch in a second direction followed by movement of said latch in a third direction into a non-interfering position, one of said directions being along the longitudinal axis of the housing, said non-interfering position being resiliently maintained, provides said lighter in an unlatched configuration in which said valve actuator is capable of being depressed, thereby permitting fuel to flow.

46. The flame developing lighter of claim 45 wherein movement of said latch is limited to movement in a single path.

47. A flame producing lighter which comprises:

a housing defining a reservoir for containing a combustible gaseous medium under pressure;

valve means operatively engaged with said reservoir for releasing fuel;

a depressible valve actuator which actuates said valve means between a normally closed position which prevents exit of said gaseous medium from said reservoir, and an open position which permits exit of gaseous medium from said reservoir through said valve means;

means for selectively producing sparks at a location proximate the gaseous medium exit opening of said valve means thereby selectively causing ignition of said gaseous medium;

an interference member which normally prevents depression of said valve actuator along a longitudinal axis of said housing, said interference member being movable inward towards and downward along the longitudinal axis of said housing to a position out of interference with depression of the valve actuator, whereby depression of the valve actuator is permitted thus selectively permitting actuation of said valve means and exit of said combustible gaseous medium from said valve means;

means for retaining said interference member in the non-interfering valve actuation position at least until said valve means is moved to the open position; and means for returning said interference member to the valve actuation prevention position once said valve actuator is depressed and released.

* * * * *

UNITED STATES PATENT AND TRADEMARK OFFICE
CERTIFICATE OF CORRECTION

PATENT NO. : 5,435,719

DATED : July 25, 1995

INVENTOR(S) : McDonough et al.

It is certified that error appears in the above-identified patent and that said Letters Patent is hereby corrected as shown below: On the title page:

Item [45]: "Date of Patent": change from "July 25, 1995" to -- *July 25, 1995--;
On the title page, insert the following:

--[*] Notice: The portion of the term of this patent subsequent to October 10, 2012 has been disclaimed.--

Signed and Sealed this

Twenty-fourth Day of March, 1998

*Attest:*

*Attesting Officer*

BRUCE LEHMAN

*Commissioner of Patents and Trademarks*